US006443554B1

(12) United States Patent
Yoshida

(10) Patent No.: US 6,443,554 B1
(45) Date of Patent: Sep. 3, 2002

(54) PRINTING DEVICE, PRINTING METHOD, AND RECORDING MEDIUM

(75) Inventor: Masahiko Yoshida, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 09/786,334

(22) PCT Filed: Jul. 6, 2000

(86) PCT No.: PCT/JP00/04500

§ 371 (c)(1),
(2), (4) Date: Mar. 8, 2001

(87) PCT Pub. No.: WO01/03930

PCT Pub. Date: Jan. 18, 2001

(30) Foreign Application Priority Data

Jul. 8, 1999 (JP) ..... 11-193915
Jul. 16, 1999 (JP) ..... 11-202595

(51) Int. Cl.[7] ..... B41J 2/15
(52) U.S. Cl. ..... 347/41; 347/43
(58) Field of Search ..... 347/41, 9, 12, 347/15, 40, 43, 16

(56) References Cited

U.S. PATENT DOCUMENTS 418,642 A 12/1889 Gillet ..... 159/29
4,920,355 A * 4/1990 Katerberg ..... 347/41
5,889,537 A * 3/1999 Shimada ..... 347/41
6,302,517 B1 * 10/2001 Kanaya ..... 347/41

FOREIGN PATENT DOCUMENTS

| | | |
|---|---|---|
| EP | 876920 | 11/1998 |
| JP | 8-267730 | 10/1996 |
| JP | 2001-1510 | 1/2001 |
| JP | 2001-113691 | 4/2001 |

* cited by examiner

*Primary Examiner*—Lamson D. Nguyen
(74) *Attorney, Agent, or Firm*—Oblon, Spivak, McClelland, Maier & Neustadt, P.C.

(57) ABSTRACT

The technique of the present invention prints an image while carrying out respective passes of main scan and sub-scan of a head assembly. Here the head assembly is obtained by combining a plurality of nozzle units arranged in a sub-scanning direction. The feeding amount of sub-scan of the head assembly is determined to make a position corresponding to each joint of adjoining nozzle units apart by at least a nozzle pitch from a certain position defined by another joint of adjoining nozzle units. The sub-scan of the head assembly by the feeding amount thus determined effectively prevents any overlap of the printing positions corresponding to the joints of adjoining nozzle units. This arrangement favorably prevents deterioration of the picture quality. The respective passes of the sub-scan may adopt a fixed feeding amount of sub-scan or alternatively adopt a set of feeding amounts of sub-scan, which includes a plurality of different feeding amounts of sub-scan. The position of connection of the adjoining nozzle units may be varied according to the feeding amount of sub-scan.

11 Claims, 22 Drawing Sheets

PRINTING DEVICE, PRINTING METHOD, AND RECORDING MEDIUM

TECHNICAL FIELD

The present invention relates to a technique that prints an image with a head assembly that is obtained by combining a plurality of nozzle units, from which ink droplets are ejected.

BACKGROUND ART

The printing apparatus that has a plurality of nozzles formed in a print head and causes ink droplets to be ejected from the respective nozzles so as to create ink dots on a printing medium and thereby complete a printed image has widely been used as an output device of various image-related equipment. The printing apparatus prints the image while repeatedly carrying out main scan and sub-scan of the print head as discussed below. This prior art technique carries out one pass of the main scan of the print head in a direction crossing an extending direction of a nozzle array to form plural arrays of ink dots (hereinafter referred to as raster lines). After a pass of the sub-scan in a direction crossing an extending direction of the raster lines, the technique carries out another pass of the main scan to form another plural raster lines at different positions. The repeated cycles of the main scan and the sub-scan of the print head form raster lines at all the possible positions on the printing medium, thereby completing a desired image on the printing medium.

In this printing apparatus, the greater number of nozzles formed in the print head effectively increases the number of raster lines formed by each pass of the main scan and thereby enhances the printing speed. The effect of the large-sized print head with the greater number of nozzles is especially significant in the case of printing on large sheets of paper like the A3 and A0 sizes, since a large number of raster lines should be formed in such large sheets of paper.

It is thought convenient to construct a head assembly by combining a plurality of nozzle units of conventionally used print heads, instead of newly manufacturing a large-sized integral print head. This method enables a head assembly of a desired size to be constructed by combining an appropriate number of nozzle units. Application of the manufacturing technique of the conventional print heads facilitates the manufacture of the head assembly, compared with the manufacture of the large-sized integral print head.

The respective nozzle units combined to construct the large-sized head assembly generally have a slight difference in ink ejection characteristics. Such variation may deteriorate the printing quality in the case of printing an image with the head assembly. Even a small error in assembling position of each nozzle unit causes the positions of all the dots created by the nozzle unit to be deviated uniformly by a fixed amount. The difference in error of the assembling position among the respective nozzle units may accordingly deteriorate the printing quality at positions corresponding to joints of adjoining nozzle units.

The object of the present invention is thus to provide a technique that prevents the printing quality from deteriorating at positions corresponding to joints of adjoining nozzle units in the case of printing an image with a large-sized print head obtained by combining a plurality of nozzle units.

DISCLOSURE OF THE INVENTION

At least part of the above and the other related objects is attained by a printing apparatus that causes ink droplets to be ejected from a nozzle array, which is formed by arranging a plurality of nozzles, so as to create ink dots on a printing medium and thereby print an image. The printing apparatus includes: a head assembly obtained by combining a plurality of nozzle units arranged in an extending direction of the nozzle array, that is, in a sub-scanning direction, where each nozzle unit has the plurality of nozzles; a raster formation unit that creates the ink dots while moving the head assembly in a main scanning direction, which crosses the sub-scanning direction, so as to form raster lines on the printing medium at intervals of a k raster lines space, where each raster line represents an array of dots; and a sub-scan unit that moves the head assembly in the sub-scanning direction, which crosses the main scanning direction, by a predetermined amount. The sub-scan unit carries out respective passes of sub-scan of the head assembly, in order to record all raster lines included in an effective area on the printing medium, each pass of the sub-scan causing a rear most nozzle included in each nozzle unit to be located at a specific position that is apart by at least k raster lines from a certain position where a rear most nozzle included in another nozzle unit is located prior to the pass of the sub-scan.

There is also a method corresponding to the printing apparatus of the above arrangement. The present invention is accordingly directed to a method of printing an image by causing ink droplets to be ejected from a nozzle array, which is formed by arranging a plurality of nozzles, to create ink dots on a printing medium while changing a relative position of the nozzle array to the printing medium. The method includes the steps of: creating ink dots while successively moving a head assembly in a direction that crosses an extending direction of the nozzle array, so as to form raster lines on the printing medium at intervals of a k raster lines space, where each raster line represents an array of dots and the head assembly is obtained by combining a plurality of nozzle units arranged in the extending direction of the nozzle array, each nozzle unit having the plurality of nozzles; and successively moving the head assembly in the extending direction of the nozzle array by a predetermined amount, so as to record all raster lines included in an effective area on the printing medium, each movement of the head assembly causing a rear most nozzle included in each nozzle unit to be located at a specific position that is apart by at least k raster lines from a certain position where a rear most nozzle included in another nozzle unit is located prior to the movement of the head assembly.

In the printing apparatus and the corresponding method of the present invention, the head assembly is subjected to each pass of the main scan that causes ink droplets to be ejected from the nozzle array, which is an alignment of the plurality of nozzle units, and thereby creates ink dots on the printing medium. This forms a plurality of raster lines at equal intervals of a k raster lines space on the printing medium. A next pass of the main scan is carried out after one pass of the sub-scan of the head assembly. The technique successively carries out the main scan and the sub-scan of the head assembly and completes a printed image on the printing medium. Here k is a natural number of not less than 1. Each pass of the sub-scan of the head assembly is carried out to cause a rear most nozzle included in each nozzle unit of the head assembly, that is, a nozzle at the opposite end in the sub-scanning direction, to be located at a specific position that is apart by at least k raster lines from a certain position where a rear most nozzle included in another nozzle unit is located prior to the pass of the sub-scan.

This arrangement causes any position printed by the joint of nozzle units in each pass of the main scan to be printed by a part of the nozzle unit other than the joint in another pass of the main scan. This effectively prevents any overlap of the printing positions corresponding to the joints of the nozzle units. Even if some difference in printing-related characteristic between the nozzle units slightly worsens the picture quality at the joint of the nozzle units, this arrangement effectively prevents the picture quality-deteriorating factors from being collectively accumulated in any specific part on a resulting printed image and thereby makes the deteriorating picture quality sufficiently inconspicuous. This arrangement further relieves the deteriorating picture quality at the joint in the course of printing and eventually ensures the good picture quality.

In order to clearly show the effects of the present invention, the following description first regards the reason for the deteriorating picture quality in the case of sub-scan that causes overlaps of printing positions corresponding to joints of nozzle units and then an arrangement of sub-scan that avoids any overlap of the printing positions corresponding to the joints of the nozzle units and thereby prevents deterioration of the printing quality. The description subsequently regards the conditions for the sub-scan that avoids any overlap of the printing positions corresponding to the joints of the nozzle unit.

FIG. 15 conceptually shows the reason for the deteriorating picture quality in the case of sub-scan that causes overlaps of printing positions corresponding to joints of nozzle units when an image is printed with a head assembly including a plurality of nozzle units.

The conceptual view of FIG. 15 shows a process of printing an image by main scan and sub-scan of a head assembly, which includes three nozzle units A, B, and C and functions like an integral print head. In the example of FIG. 15, the nozzle units A, B, and C have an identical nozzle arrangement, and each pass of the sub-scan shifts the head assembly by ⅓ of the whole length of the head assembly. In order to record all possible raster lines on the printing medium by the sub-scan of a nozzle array, the nozzle array and the amount of sub-scan should hold a predetermined relationship, which will be discussed later. In the specification hereof, to appropriately select the amount of sub-scan for the nozzle array and enable formation of all possible raster lines on the printing medium is referred to as 'to complete the interlace'.

The following describes the meaning of FIG. 15. In the first pass of the main scan of the head assembly, the three nozzle units A, B, and C included in the head assembly are respectively located at positions A1, B1, and C1 to form raster lines. The first pass of the sub-scan of the head assembly by ⅓ of the whole length of the head assembly respectively moves the nozzle units A, B, and C to positions A2, B2, and C2 to form raster lines. The next pass of the sub-scan causes the nozzle units A, B, and C to respectively form raster lines at positions A3, B3, and C3. The procedure repeatedly carries out the main scan and the sub-scan of the head assembly to form all the possible raster lines on the printing medium and thereby complete a desired printed image on the printing medium.

The three nozzle units A, B, and C form a continuous nozzle array, but the individual difference among the nozzle units subtly varies the ejection characteristic of the ink droplets and may the assembled construction undesirably recognized. There may also be attachment error. For example, it is assumed that the actual attachment position of the nozzle unit B to the nozzle unit A is farther by dL from its designed attachment position; that is, the attachment position of the nozzle unit B to the nozzle unit C is closer y dL from its designed attachment position. This causes the raster lines formed by the nozzle unit B to be uniformly deviated by dL. In this case. the boundary between the nozzle units A and B and the boundary between the nozzle units B and C are made undesirably conspicuous.

In the example of FIG. 15, at the position defined by the arrow P12, the boundary between the nozzle units B and C in the first pass of the main scan overlaps with the boundary between the nozzle units A and B in the second pass of the main scan. As described previously, the position printed by the joint of the nozzle units has the deteriorating picture quality, due to the individual difference between the nozzle units and the attachment error of the nozzle unit. The positions printed by the joints of the nozzle units in an overlapping manner like the position of the arrow P12 may be undesirably conspicuous and thus worsen the printing quality. The deteriorating picture quality due to the conspicuous printing position corresponding to the joint of the nozzle units may be found not only at the position of the arrow P12 but at any other positions, for example, at the positions defined by the arrows P23 and P34 in the example of FIG. 15.

When the amount of sub-scan of the head assembly has some error, the printing position corresponding to the rear most end of the head assembly is made undesirably conspicuous to worsen the picture quality. This phenomenon is described with regard to the position P12 in the example of FIG. 15. Raster lines are formed at equal intervals in both the areas A2 and A3 by the identical nozzle unit A. It is accordingly thought that the intervals between any adjoining raster lines are identical in these two areas. In the case where the amount of sub-scan of the head assembly has some error, for example, an excess of dS, there is a region having the wider interval between adjoining raster lines by dS on the boundary between the areas A2 and A3. In this region, the boundary between the area printed in the second pass of the main scan (that is, the area A2) and the area printed in the third pass of the main scan (that is, the area A3) is made undesirably conspicuous. When the error is an insufficiency of dS, on the other hand, there is a region having the narrower interval between adjoining raster lines by dS on the boundary between the areas A2 and A3. In this region, the boundary between the two areas is also made conspicuous. When the amount of sub-scan has some error, there is a discontinuous area having the varied interval between adjoining raster lines at the rear most end of the head assembly. Such discontinuousness often worsens the picture quality.

In the example shown in FIG. 15, the picture quality-deteriorating factor due to the individual difference between the adjoining nozzle units and the attachment error arises at identical positions where the picture quality-deteriorating factor due to the error in amount of sub-scan of the nozzle unit arises. The printing quality may thus be significantly worsened at such positions. For example, at the position defined by the arrow P12, the picture quality-deteriorating factor arising at the joint of nozzle units A2 and B2 is combined with the picture quality-deteriorating factor arising on the boundary between the nozzle units A2 and A3. The picture quality may thus be significantly worsened at the position of the arrow P12. In the actual design, in order to prevent deterioration of the picture quality due to the individual factors, the individual difference between the adjoining nozzle units, the attachment error, and the error in amount of sub-scan are limited to low levels. Accumulation of these factors, however, naturally causes deterioration of the printing quality. This happens not only at the position of the arrow P12 but at other positions, for example, those defined by the arrows P23 and P34. The sub-scan that makes the printing positions corresponding to the joints of the nozzle units overlap each other may worsen the printing quality.

FIG. 16 shows one example of the sub-scan that avoids any overlap of the printing positions corresponding to the joints of the nozzle units. The total number of nozzles and the interval between the nozzles are identical with those of the example shown in FIG. 15. The same value is also set to the amount of sub-scan. The difference from the example of FIG. 15 is that the position of the joint of the adjoining nozzle units is changed to prevent the printing positions corresponding to the joints of any nozzle units from overlapping each other in the course of the sub-scan of the head assembly. In the example of FIG. 16, the number of nozzle units included in the head assembly is changed from 3 to 2 with a view to changing the position of the joint of the nozzle unit. In another possible procedure, the number of nozzles included in each nozzle unit may be varied among the nozzle units A, B, and C.

In the example of FIG. 16, the printing position defined by the arrow Q1 corresponds to the joint of the nozzle units A and B. There is accordingly the picture quality-deteriorating factor due to the individual difference between the two nozzle units and the attachment error of the nozzle unit. Unlike the example of FIG. 15, however, another picture quality-deteriorating factor does not appear in combination at this position. It is accordingly possible to prevent the picture quality from being significantly worsened at this position by reducing the individual difference between the nozzle units and the attachment error.

At the position defined by the arrow R23 in the example of FIG. 16, there is the picture quality-deteriorating factor due to the error in amount of sub-scan of the head assembly. Another picture quality-deteriorating factor, however, does not appear in combination at this position. It is accordingly possible to prevent the picture quality from being significantly worsened at this position by reducing the error in amount of sub-scan.

In the example of FIG. 16, the two picture quality-deteriorating factors do not arise in combination at an identical position. It is accordingly possible to prevent deterioration of the picture quality by reducing the individual difference between nozzle units, the attachment error, and the error in feeding amount of sub-scan to the extent that the individual factors alone do not worsen the picture quality.

As described above, the appropriate sub-scan of the head assembly to avoid any overlap of the printing positions corresponding to the joints of the adjoining nozzle units included in the head assembly effectively prevents deterioration of the picture quality at such printing positions. The following describes the conditions to be fulfilled for the appropriate sub-scan that avoids any overlap of the printing positions corresponding to the joints of the nozzle units.

FIG. 17 is an enlarged view showing the joint between nozzle units A and B in an n-th pass of the main scan and the joint between nozzle units C and D in an m-th pass of the main scan. In the illustration of FIG. 17, the nozzles actually present on the nozzle unit are shown by the thick solid lines. The phantom nozzles between the actually existing nozzles are shown by the thin dotted lines with a view to clearly showing that the respective nozzles are aligned at equal intervals. In the example of FIG. 17, the respective nozzles are aligned at equal intervals of a four nozzles space. The nozzle interval between adjoining nozzle units (between the nozzle units A and B or between the nozzle units C and D) is also equal to the four nozzles space.

There is the picture quality-deteriorating factor due to the individual difference between the adjoining nozzle units and the error in positioning of the nozzle unit at the joint of the nozzle units A and B (that is, on a boundary IAB between a nozzle unit An and a nozzle unit Bn in the drawing) in the n-th pass of the main scan. In a similar manner, there is the picture quality-deteriorating factor due to, for example, the individual difference between the adjoining nozzle units at the joint of the nozzle units C and D (that is, on a boundary ICD in the drawing) in the m-th pass of the main scan. Under the conditions shown in FIG. 17(*a*), the two picture quality-deteriorating factors arise in an overlapping manner in an area defined by IAB+ICD. The picture quality may thus significantly deteriorate in this area.

In the example of FIG. 17(*b*), the amount of sub-scan of the head assembly is increased by a two nozzles space from the example of FIG. 17(*a*). As clearly understood from the illustration, in the case of FIG. 17(*b*), the picture quality-deteriorating factor arising at the joint between the nozzle units A and B is not combined with the picture quality-deteriorating factor arising at the joint between the nozzle units C and D at any position. It is accordingly possible to prevent deterioration of the picture quality by reducing the individual difference between nozzle units and the attachment error to the extent that the individual factors alone do not worsen the picture quality.

In the example of FIG. 17(*c*), the amount of sub-scan of the head assembly is decreased by an eight nozzles space from the example of FIG. 17(*a*). In the case of FIG. 17(*c*), the picture quality-deteriorating factor arising at the joint between the nozzle units A and B is not combined with the picture quality-deteriorating factor arising at the joint between the nozzle units C and D at any position. It is accordingly possible to prevent deterioration of the picture quality by reducing the individual difference between nozzle units and the attachment error.

The attention is here paid to the rear most nozzle in each nozzle unit (for example, the nozzle at the rear most end of either the nozzle unit B or the nozzle unit D shown by the closed circle) in FIGS. 17(*a*) through 17(*c*). The following condition should be satisfied for the sub-scan that avoids any overlap of the printing positions corresponding to the joints of the nozzle units. The required condition of the sub-scan is to make the current position of the rear most nozzle in one nozzle unit (for example, the nozzle at the rear most end of the nozzle unit D shown by the closed circle) apart by at least the nozzle pitch k from a certain position where the rear most nozzle in another nozzle unit (for example, the nozzle at the rear most end of the nozzle unit B shown by the closed circle) is located previously. This arrangement effectively prevents any overlap of the printing positions corresponding to the joints of the nozzle units.

The substantially similar discussion is applicable for the picture quality-deteriorating factor due to the error in amount of sub-scan of the head assembly. When the amount of sub-scan has some error, the interval between newly formed raster lines is slightly deviated from the interval between existing raster lines formed prior to the sub-scan. This results in discontinuousness of the part adjacent to the rear most nozzle in the head assembly and makes the joint of the nozzle units undesirably conspicuous in this part. This phenomenon is described below with reference to the example of FIG. 18. FIG. 18 is an enlarged view showing the positional relationship between the joint of nozzle units A and B in an n-th pass of the main scan and the rear most end of the nozzle unit A in an (n+1)-th pass of the main scan. When the amount of sub-scan has some error, the raster line formed by the rear most nozzle in the nozzle unit A in the (n+1)-th pass of the main scan is not located at the expected position. The interval from the adjoining raster line formed in the n-th pass is not an integral multiple of the width of the raster line. This may give the discontinuous impression and thus deteriorate the picture quality in an area adjacent to the rear most end of the nozzle unit A (an area Ea in the drawing). The picture quality-deteriorating factor arising at the joint between the nozzle units A and B is also present in this area. The combination of the two picture quality-deteriorating factors makes the deteriorating picture quality recognizable. It is accordingly required to make the position of the rear most nozzle in the nozzle unit A apart by at least the nozzle pitch k from the position where the rear most nozzle in another nozzle unit is located previously. This arrangement favorably prevents the picture quality from being worsened by the combination of the two picture quality-deteriorating factors.

In the printing apparatus and the corresponding method of the present invention, the sub-scan of the head assembly is carried out to record all the raster lines included in the effective area on the printing medium and to make the rear most nozzle in each nozzle unit apart by at least k raster lines from the certain position where the rear most nozzle in another nozzle unit is located prior to the sub-scan. This arrangement effectively prevents deterioration of the picture quality caused by the combination of the picture quality-deteriorating factor arising at each joint of adjoining nozzle units due to the individual difference between the nozzle units with the picture quality-deteriorating factor arising at the rear most end of the head assembly due to the error in feeding amount of sub-scan of the nozzle unit.

In accordance with one preferable application of the present invention, the printing apparatus has the head assembly where the joints of the respective nozzle units included therein satisfy the following conditions, while setting the amount of sub-scan equal to N raster lines that corresponds to the number of effective raster lines. The number of effective raster lines represents the net number of raster lines formed by one pass of the main scan. For example, each raster line is formed by two passes of the main scan. In general, it is the that N' raster lines are formed by s passes of the main scan. In this general case, it is thought that each pass of the main scan forms N'/s raster lines. Namely the number of effective raster lines is equal to N'/s. The position of the connection of any adjoining nozzle units is adjusted to make the joint of the nozzle units apart by at least k raster lines from a specified position. The specified position here is apart by an integral multiple of the number of effective raster lines, which is equal to N, from the rear most nozzle in each nozzle unit included in the head assembly. The amount of sub-scan is set equal to N raster lines, which corresponds to the number of effective raster lines, since this condition is required to complete the interlace as discussed later.

When a fixed value (corresponding to N raster lines) is set to the amount of sub-scan, every pass of the sub-scan shifts the rear most nozzle in each nozzle unit by N raster lines. The sub-scan that makes the position of the rear most nozzle apart by at least k raster lines from the position of the joint of the adjoining nozzle units effectively prevents any overlap of the printing positions corresponding to the joints of the adjoining nozzle units to worsen the picture quality. In a similar manner, this arrangement also effectively prevents any overlap of the printing positions corresponding to the rear most end of the head assembly and the joint of the adjoining nozzle units. This arrangement accordingly prevents deterioration of the picture quality caused by the combination of the picture quality-deteriorating factor due to the error in feeding amount of sub-scan with the picture quality-deteriorating factor due to the individual difference between the nozzle units.

Even in the case where each raster line is completed by one pass of the main scan, the number of effective raster lines N on the head assembly is not always coincident with the total number of nozzles. One modified application appropriately selects effective nozzles among all the nozzles provided on the head assembly to attain a predetermined nozzle pitch and uses only the selected nozzles to eject ink droplets.

In accordance with one preferable application of the present invention, the printing apparatus has the head assembly of the following configuration, while setting the amount of sub-scan equal to N raster lines that corresponds to the number of effective raster lines. The head assembly forms raster lines at equal intervals of a k raster lines space by each pass of the main scan. Each of the nozzle units included in the head assembly forms n raster lines by each pass of the main scan. In order to complete the interlace, N and k should be prime to each other as described later. The head assembly should also be designed to satisfy the relationship of $(n/s) \geqq k$. Selection of N, k, n, s satisfying such conditions effectively prevents the printing position corresponding to the joint of any pair of adjoining nozzle units or the rear most end of the head assembly from overlapping with the printing position corresponding to the joint of another pair of adjoining nozzle units. Here the condition that N and k are prime to each other means that the greatest common divisor of the two integers N and k is equal to 1.

The reason why the arrangement of fulfilling the above conditions prevents any overlap of the printing position corresponding to the joint of each pair of adjoining nozzle units or the rear most end of the head assembly with the printing position corresponding to the joint of another pair of adjoining nozzle units will be discussed later, since the reason is also related to the conditions to complete the interlace.

The printing apparatus of the present invention may use the head assembly having the following configuration and satisfying the conditions specified below for the amount of sub-scan. The head assembly forms raster lines at equal intervals of a k raster lines space in each pass of the main scan, where each nozzle unit forms n raster lines. In this application, a set of feeding amounts of sub-scan, which include a plurality of different feeding amounts, are stored in advance. The set of feeding amounts of sub-scan are defined by that the absolute value of a difference between each cumulative value, which is obtained by successively accumulating the feeding amounts of sub-scan, and an integral multiple of $n \times k$ is not less than k.

The successive sub-scan of the head assembly according to the set of feeding amounts of sub-scan thus stored causes the joint of each pair of adjoining nozzle units to be shifted by the cumulative value of the feeding amounts of sub-scan. Each nozzle unit forms n raster lines at the equal intervals of the k raster lines space. The joints of the nozzle units are accordingly present at an interval of an $n \times k$ raster lines space. When the absolute value of the difference between the cumulative value of the feeding amounts of sub-scan and the integral multiple of n×k is less than k, there are overlaps of the printing positions corresponding to the joints of the nozzle units. The arrangement of selecting and storing the set of feeding amounts of sub-scan to make the absolute value of the difference not less than k thus desirably prevents any overlap of the printing positions corresponding to the joints of the nozzle units in the course of the sub-scan of the head assembly.

One applicable procedure first specifies the configuration of the head assembly, such as the interval between adjoining raster lines and the number of raster lines formed in each pass of the main scan and the structure of the nozzle units included in the head assembly, and then selects the amount of sub-scan to fulfill the respective conditions discussed above, based on the specified configuration of the head assembly. Another applicable procedure, on the contrary, first selects the amount of sub-scan and then determines the configuration of the head assembly and the positions of the joints of the adjoining nozzle units.

The technique of the present invention may be attained by carrying out sub-scan and main scan of a head assembly according to the method discussed above in a computer system, which includes a printing apparatus that has the head assembly obtained by combining a plurality of nozzle units, and a computer that controls the printing apparatus. Namely the present invention may be constructed as a recording medium in which a program for actualizing the method is recorded in a computer readable manner.

The present invention is thus directed to a recording medium in which a program is recorded in a computer readable manner to actualize a method of printing an image by causing ink droplets to be ejected from a nozzle array, which is formed by arranging a plurality of nozzles, to create ink dots on a printing medium while changing a relative position of the nozzle array to the printing medium. The program causes a computer to attain the functions of: creating ink dots while successively changing the relative position of the nozzle array to the printing medium in a direction that crosses an extending direction of the nozzle array, so as to form raster lines on the printing medium at intervals of a k raster lines space, where each raster line represents an array of dots; and successively changing the relative position of the nozzle array to the printing medium in the extending direction of the nozzle array by a predetermined amount, so as to record all raster lines included in an effective area on the printing medium, each change of the relative position causing a rear most nozzle included in each nozzle unit among plural nozzle units to be located at a specific position that is apart by at least k raster lines from a certain position where a rear most nozzle included in another nozzle unit among the plural nozzle units is located prior to the change of the relative position, where each nozzle unit has the plurality of nozzles.

The computer reads the program to attain such functions and controls the main scan and the sub-scan of the head assembly including the plurality of nozzle units. This arrangement also effectively prevents the picture quality from being worsened by any overlap of the printing positions, for example, corresponding to the joints of the nozzle units.

In accordance with one preferable application of the printing apparatus of the present invention discussed above, a plurality of head assemblies are arranged in the main scanning direction to satisfy the following positional relationship. Each nozzle unit included in the head assembly may have the ejection characteristic of the ink droplets that periodically varies in the sub-scanning direction, due to the structure of the nozzle unit. The plurality of head assemblies are thus arranged to be shifted in position in the sub-scanning direction, such that the periodic variations in ejection characteristic of the ink droplets in the respective head assemblies do not overlap one another.

In one concrete embodiment, the respective head assemblies may be arranged to prevent their periodic variations in at least one of ejection speed of the ink droplets and ejection amount of the ink droplets from overlapping one another.

There are a variety of reasons for the periodic variation in ejection characteristic of the ink droplets. For example, in a nozzle array consisting of a large number of nozzles provided on the nozzle unit, each end portion of the nozzle array has three sides fixed by the walls of the nozzle unit, whereas the central portion of the nozzle array has only two sides fixed by the walls of the nozzle unit. This leads to a variation in rigidity of the nozzle unit. In the event that a reinforcement is attached to the central portion of the nozzle array to supply the additional rigidity, the end portions and the central portion of the nozzle unit have the higher rigidity, while the other portions of the nozzle unit have relatively lower rigidity.

The variation in ejection characteristic of the ink droplets may be ascribed to variations of the ink supply system and the electrical system as well as to the variation in rigidity of the nozzle unit. In the case of the long nozzle array, the nozzle array may be divided into a plurality of blocks, and the supply of ink and the supply of electric power for driving the nozzles may be regulated in each block. In this case, the division into the plural blocks may cause the periodic variation in ejection characteristic of the ink droplets. The variation in ink ejection characteristic generally worsens the printing quality.

In the application of the present invention, however, a head assembly group is obtained by combining a plurality of head assemblies in the main scanning direction. The respective head assemblies are arranged to prevent their periodic variations in ejection characteristic of the ink droplets from overlapping one another. This arrangement desirably suppresses the total periodic variation in the group of the head assemblies, thus improving the printing quality.

FIG. 19 conceptually shows an arrangement of plural nozzle units in such a manner that their periodic variations in ink ejection characteristic are successively shifted and thereby cancelled out. The left side of the drawing shows an arrangement of two nozzle units, and the right side of the drawing shows ink dots respectively created by the two nozzle units. As clearly understood from the ink dots created by the respective nozzle units, in the example of FIG. 19, each nozzle unit has the variation of three periods. The arrangement of mutually shifting the period of the variation in each nozzle unit averages the variations in ejection characteristic of the ink droplets. Especially the arrangement of shifting the variation by half the period causes the antinodes of the periodic variations to overlap the nodes of the periodic variations, thus most effectively averaging the variations in ink ejection characteristic. The parts of the two nozzle units that do not overlap each other in the main scanning direction may or may not contribute to creation of ink dots.

In accordance with one embodiment of the printing apparatus having the head assembly group discussed above, the plurality of head assemblies included in the head assembly group may be arranged, such that nozzle positions in the respective head assemblies are shifted in the main scanning direction by approximately half a nozzle pitch. This arrangement averages the variations in ink ejection characteristic of the nozzle units, while attaining a small nozzle pitch in the head assembly group. This arrangement is discussed with reference to FIG. 20. FIG. 20 shows an arrangement of a head assembly group that includes two head assemblies combined with each other in the main scanning direction, where each head assembly includes two nozzle units combined with each other in the sub-scanning direction. A variation in ink ejection characteristic of one period is assumed here, where the ink ejection speed or the amount of ink ejection decreases in both end portions of each nozzle unit and increase in the central portion. The arrangement of the two head assemblies to prevent their periodic variations of the nozzle units from overlapping each other desirably averages the variations in ink ejection characteristic. This arrangement also causes the nozzles of the two head assemblies to be positioned alternately, thus giving a nozzle array having a small nozzle pitch.

In accordance with another embodiment of the printing apparatus having the head assembly group discussed above, the plurality of head assemblies included in the head assembly group may be arranged, such that nozzle positions in the respective head assemblies are identical in the main scanning direction. This arrangement also averages the variations in ink ejection characteristic of the nozzle units. In this case, ink droplets may be ejected simultaneously from one nozzle unit as shown in FIG. 21 or may be ejected alternately from the two nozzle units as shown in FIG. 22. In either case, the arrangement of making the nozzle positions coincident with each other in the main scanning direction enables each raster line to be formed with two nozzles. This makes the subtle variation in ink ejection characteristic due to the individual difference between the nozzle units significantly inconspicuous, thus improving the printing quality.

BEST MODES OF CARRYING OUT THE INVENTION

Figure 1:
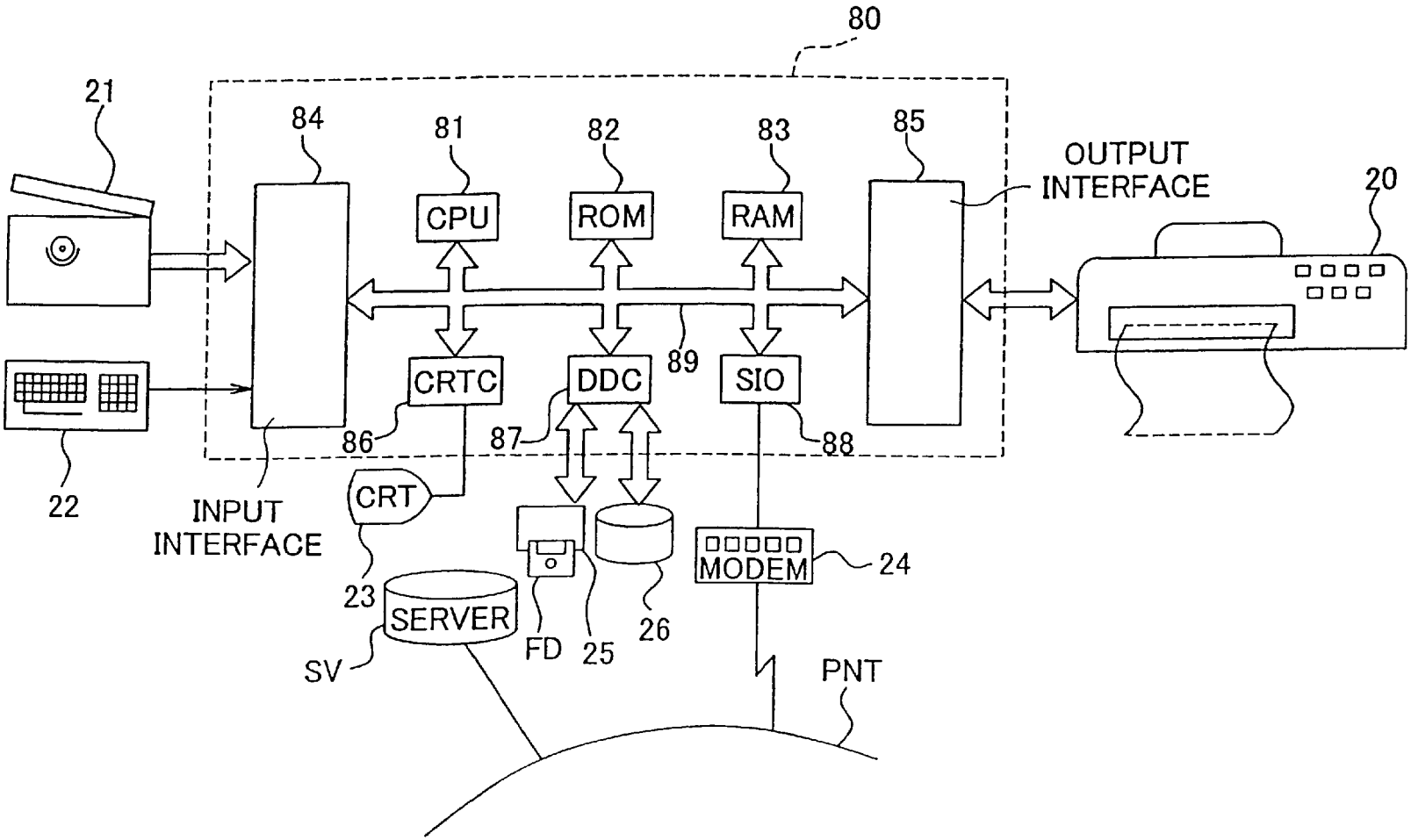
FIG. 1 schematically illustrates the structure of a printing system in one embodiment of the present invention.

Preferred modes of carrying out the present invention are described below in the following sequence:

A. Structure of Apparatus
B. Outline of Image Processing
C. Conditions to Complete Interlace
  C-1. Simplest Conditions to Complete Interlace
  C-2. Conditions to Complete Interlace in First modified method (Overlap)
  C-3. Conditions to Complete Interlace in Second modified method (Irregular Feeding)
D. Arrangements Applicable for Sub-scan of Head Assembly in Color Printer of Embodiment
  D-1. First Arrangement
  D-2. Second Arrangement
  D-3. Third Arrangement A. Structure of Apparatus Some modes of carrying out the present invention are described as preferred embodiments. FIG. 1 illustrates the structure of a printing system in one embodiment of the present invention. The illustrated printing system includes a computer 80 connecting with a color printer 20. The computer 80 reads and executes predetermined programs, so as to attain the functions of the printing system. A color original of interest to be printed may be read by a color scanner 21 connecting with the computer 80 or may be any of images generated by application programs 91 on the computer 80. A CPU 81 incorporated in the computer 80 converts original image data ORG into printable image data and outputs the printable image data as final image data FNL to the color printer 20. The color printer 20 creates ink dots of the respective colors on the printing medium based on the input image data FNL, so as to print a color image corresponding to the color original on the printing medium.

The computer 80 includes the CPU 81 that carries out a diversity of arithmetic and logic operations, a RAM 82 that temporarily stores data therein, a ROM 83 that stores a variety of programs therein, and a hard disk 26. Connection of an SIO 88 with a public telephone network PNT via a modem 24 enables required data and programs to be downloaded from a server SV on an external network into the hard disk 26.

The color printer 20 is capable of printing color images. In this embodiment, an ink jet printer that creates dots of four different colors, cyan, magenta, yellow, and black, on printing paper to print color images is applied for the color printer 20. The ink jet printer used in this embodiment adopts an ink ejection method using piezoelectric elements PE as discussed later. Another printer having a nozzle unit that ejects ink according to another principle may be used in place of the ink jet printer. For example, the technique of the present invention may be applied to a printer that supplies electric power to a heater disposed in each ink conduit and ejects ink by means of bubbles produced in the ink conduit.

Figure 2:
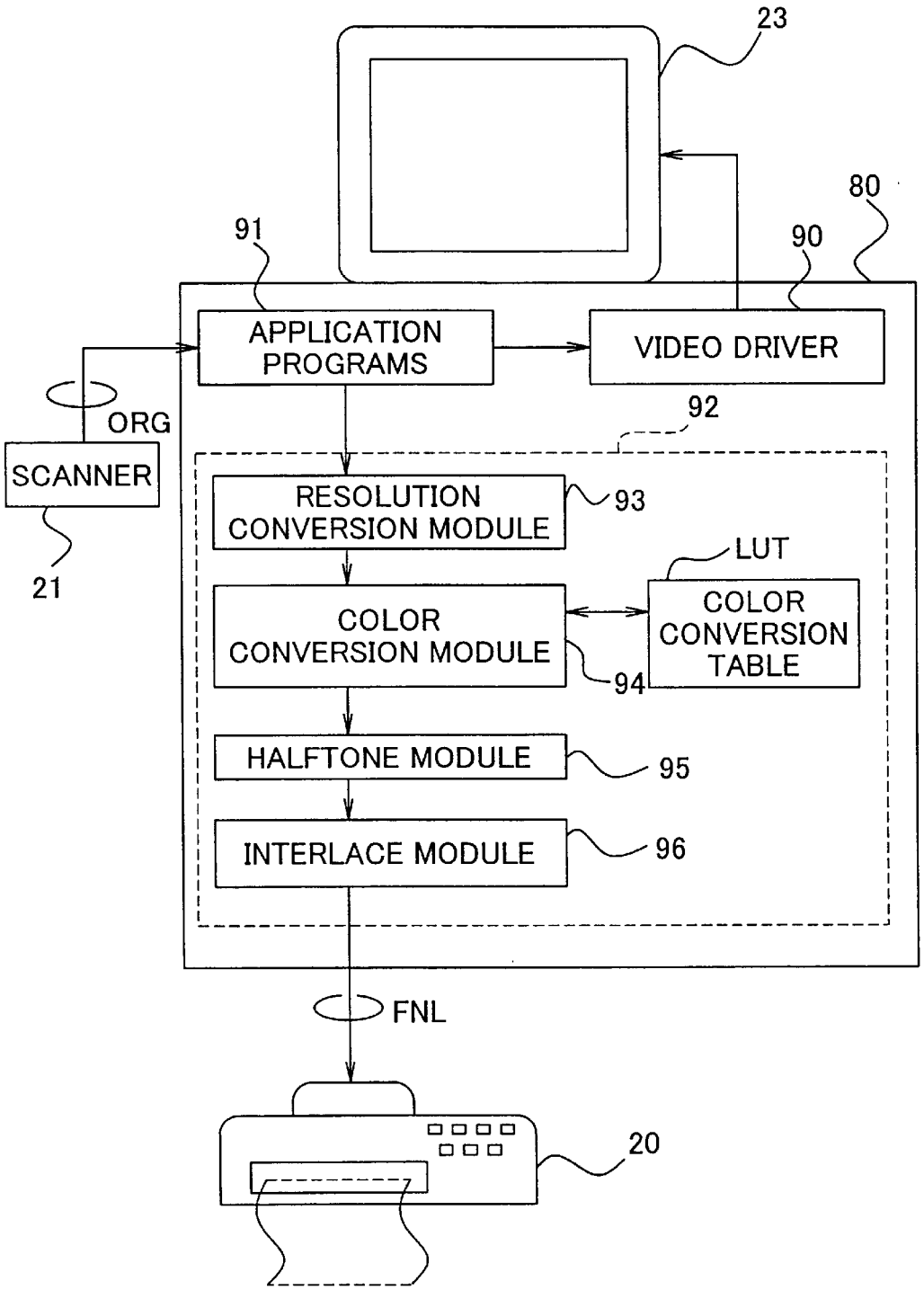
FIG. 2 shows the software configuration of the printing system.

FIG. 2 is a block diagram conceptually showing the software configuration of the printing system. In the computer 80, all the application programs 91 work under an operating system. A video driver 90 and a printer driver 92 are incorporated in the operating system. Image data from each application program 91 are output to the color printer 20 via this printer driver.

In response to a printing instruction issued by each application program 91, the printer driver 92 in the computer 80 receives image data from the application program 91 and carries out a predetermined series of image processing to convert the input image data to final image data printable by the printer. As shown conceptually in FIG. 2, the series of image processing executed by the printer driver 92 is mainly divided into four modules, that is, a resolution converting module 93, a color converting module 94, a halftoning module 95, and an interlace module 96. The details of the image processing carried out in each module will be discussed later. The image data input into the printer driver 92 are subjected to the successive conversions carried out in these modules and output as the final image data FNL to the color printer 20. The color printer 20 of this embodiment simply functions to create dots based on the image data FNL and does not carry out any part of the image processing. In a modified structure, however, the color printer 20 may carry out part of the image processing.

Figure 3:
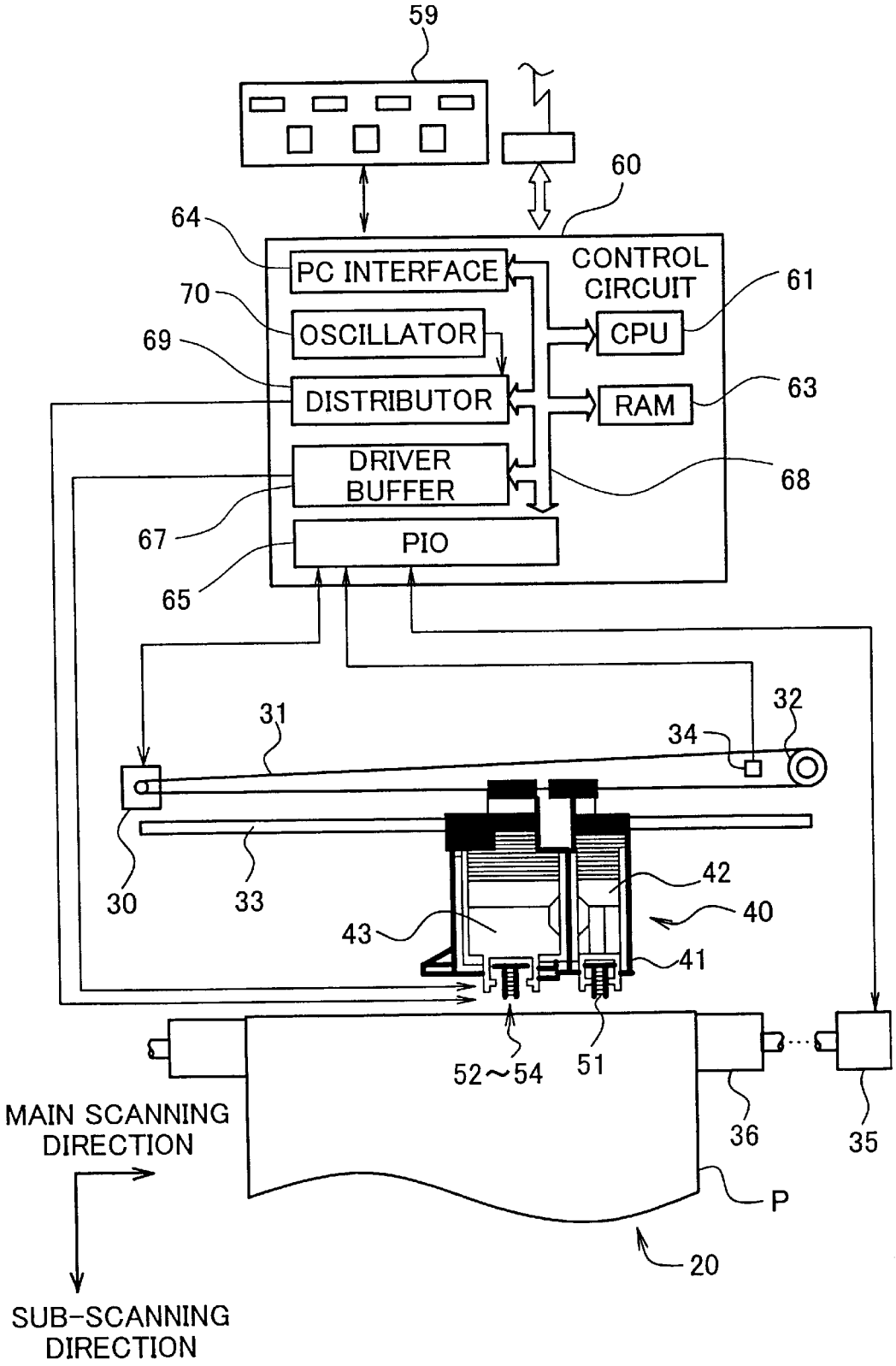
FIG. 3 schematically illustrates the structure of a printer included in the printing system of the embodiment.

FIG. 3 schematically illustrates the structure of the color printer 20 of this embodiment. As illustrated, the color printer 20 has a mechanism that drives head assemblies 51 through 54 for respective colors mounted on a carriage 40 to eject ink and create dots, a mechanism that moves back and forth the carriage 40 along an axis of a platen 36 by means of a carriage motor 30, a mechanism that feeds a sheet of printing paper P by means of a sheet feed motor 35, and a control circuit 60.

Each of the head assemblies 51 through 54 provided for the respective colors includes a plurality of nozzle units. Nozzles in the plurality of nozzle units form an integral nozzle array. The detailed structures of the head assemblies will be discussed later.

The mechanism that reciprocates the carriage 40 along the axis of the platen 36 includes a sliding shaft 33 that supports the carriage 40, which is arranged in parallel with the axis of the platen 36, in a slidable manner, a pulley 32 that is combined with the carriage motor 30 to hold an endless drive belt 31 spanned therebetween, and a position detection sensor 34 that detects the position of the origin of the carriage 40.

The mechanism that feeds the printing paper P includes the platen 36, the sheet feed motor 35 for rotating the platen 36, a non-illustrated feed assist roller, and a gear train (not shown) for transmitting the rotations of the sheet feed motor 35 to the platen 36 and the feed assist roller. The printing paper P is set between the platen 36 and the feed assist roller and is fed by a predetermined amount according to the rotational angle of the platen 36.

The control circuit 60 includes a PC interface 64 that transmits data to and from the computer 80, a peripheral equipment input-output unit (PIO) 65 that transmits data to and from peripheral equipment like the sheet feed motor 35 and the carriage motor 30, a drive buffer 67 that supplies dot on-off signals to the head assemblies 51 through 54, a CPU 61 that controls these preceding constituents, and a RAM 63 that temporarily stores data therein. The control circuit 60 further includes an oscillator 70 that outputs driving waveforms and a distributor 69 that distributes the output of the oscillator 70 into the head assemblies 51 through 54 at preset timings.

The CPU 61 outputs a driving signal to the carriage motor 30 and a trigger signal to the oscillator 70, reads the dot on-off signals stored in the RAM 63 synchronously with the trigger signal, and outputs the dot on-off signals to the drive buffer 67. Under the control of the CPU 61, while main scan of the carriage 40 is carried out, ink droplets are ejected from the respective nozzles formed in the nozzle units. The CPU 61 also controls the operation of the sheet feed motor 35 synchronously with the movement of the carriage. As a result, ink dots are created at appropriate positions on the printing paper.

An ink cartridge 42 that keeps black (K) ink therein and another ink cartridge 43 that keeps three color inks, cyan (C), magenta (M), and yellow (Y), therein are detachably attached to the carriage 40. In one possible modification, the black ink K and a plurality of color inks may be kept in one identical ink cartridge. In another possible modification, a plurality of color inks may be kept separately in different ink cartridges. The arrangement of keeping a plurality of different inks in one identical ink cartridge advantageously reduces the total space required for ink cartridges. When the ink cartridges 42 and 43 are attached to the carriage 40, the respective inks in the ink cartridges flow through non-illustrated inlet pipes and are supplied to the head assemblies 51 through 54 for the respective colors. The ink supplied to each nozzle unit is ejected to create dots on the printing paper by the procedure discussed below.

Figure 4A:
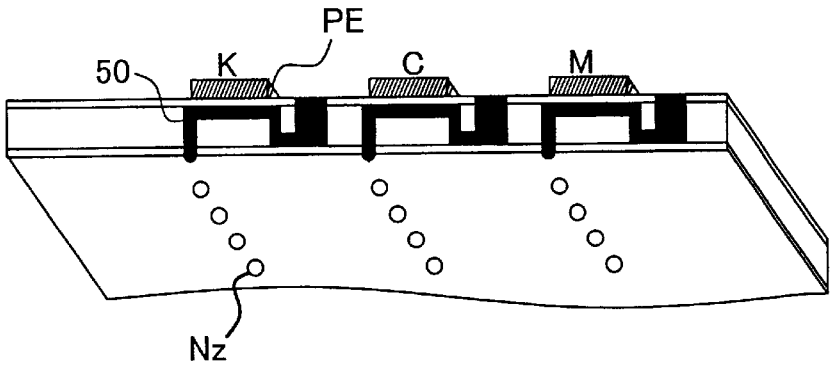
FIGS. 4A–B shows the principle of dot creation in the printer of the embodiment.
Figure 4B:
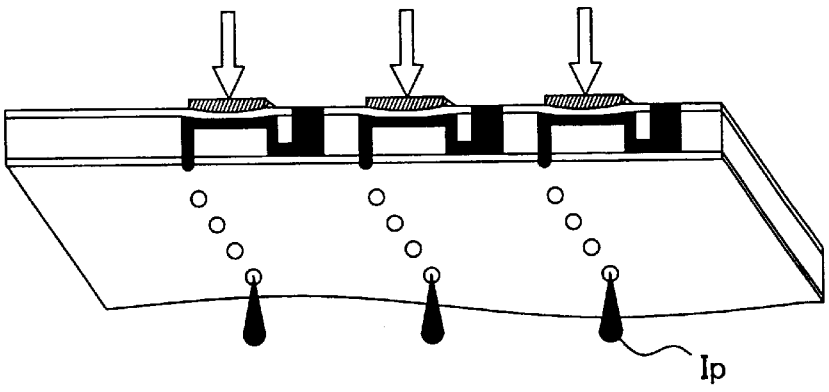

FIG. 4(*a*) shows the internal structure of each nozzle unit included in the head assembly. Each nozzle unit included in the head assemblies 51 through 54 for the respective colors has 320 nozzles Nz. Each nozzle has an ink conduit 50 leading thereto and a piezoelectric element PE located on the ink conduit 50. As is known by those skilled in the art, the piezoelectric element PE deforms its crystal structure by application of a voltage and implements an extremely high-speed conversion of electrical energy into mechanical energy. In the structure of the embodiment, when a preset voltage is applied between electrodes on either end of the piezoelectric element PE for a predetermined time period, the piezoelectric element PE is expanded for the predetermined time period to deform one side wall of the ink conduit 50 as shown by the arrows in FIG. 4(*b*). The volume of the ink conduit 50 is reduced according to the expansion of the piezoelectric element PE. A certain amount of ink corresponding to the reduction is ejected as an ink particle Ip from the nozzle Nz at a high speed. The ink particles Ip soak into the printing paper P set on the platen 36, so as to create dots on the printing paper P. The size of the ink droplets thus ejected can be adjusted by regulating the voltage waveform applied to the piezoelectric elements PE. The adjustment of the size of the ejected ink droplets results in regulating the size of the ink dots created on the printing paper.

Figure 5A:
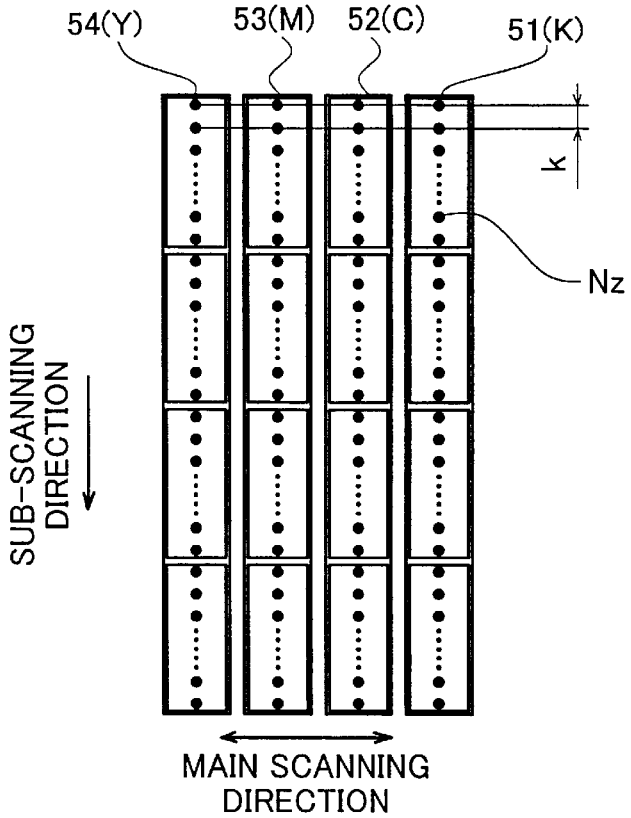
FIGS. 5A–B show possible arrangements of head assemblies used in the printer of the embodiment, where each head assembly is obtained by combining a plurality of nozzle units.
Figure 5B:
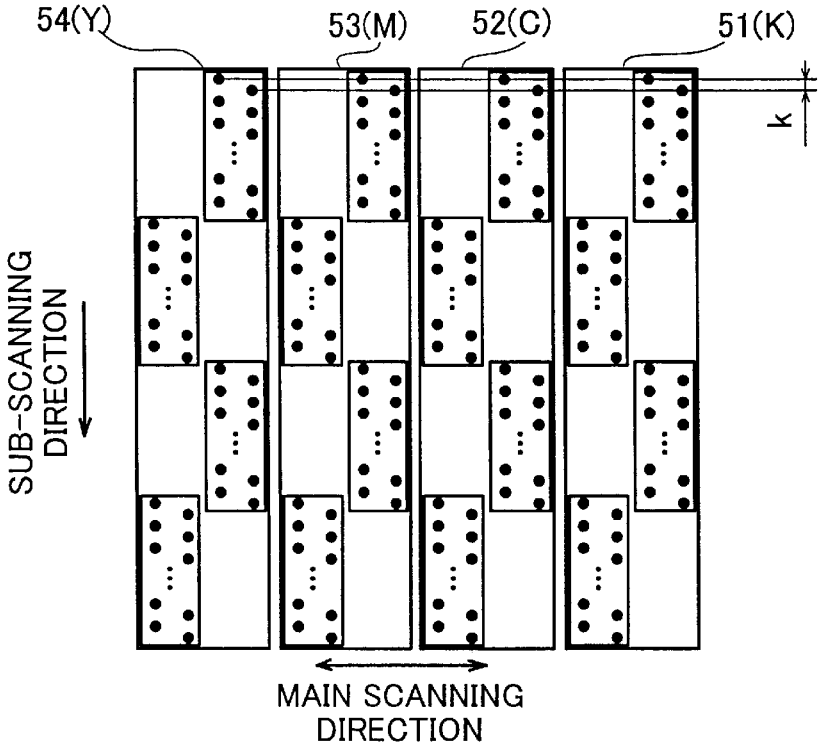

FIG. 5 shows possible arrangements of the head assemblies for the respective colors, where each head assembly is obtained by combining a plurality of nozzle units. As shown in FIG. 5(*a*), each head assembly for each color includes four nozzle units that are aligned in a column, where each nozzle unit has 320 nozzles at a nozzle pitch k. Namely each head assembly includes 1,280 (4×320) nozzles, which form one nozzle array. Adjoining nozzle units are positioned, such that the nozzle interval at the joint of the adjoining nozzle units is equal to the nozzle pitch k. The head assembly accordingly functions as one large-sized integral head.

In the case where a small value is set to the nozzle pitch k, adjoining nozzle units are positioned to have a partial overlap as shown in FIG. 5(*b*). Such positioning enables the nozzle interval at the joint of the adjoining nozzle units to be equal to the small nozzle pitch k. In the example of FIG. 5(*b*), in order to set a small value to the nozzle pitch k, 320 nozzles in each nozzle unit are arranged in zigzag. This arrangement effectively attains the small nozzle pitch k, which is substantially equivalent to half the manufacturing nozzle interval, without actually changing the manufacturing nozzle interval on the nozzle unit.

As shown in FIG. 5, the head assemblies 51 through 54 for the respective colors are shifted in position in the moving direction of the carriage 40. In the zigzag arrangement of the nozzles as in the case of FIG. 5(*b*), there are positional shifts with regard to nozzles included in one head assembly for each color in the moving direction of the carriage 40. The control circuit 60 in the color printer 20 moves the carriage 40 and drives the respective nozzle units at appropriate timings to eject ink droplets by taking into account such positional shifts of the nozzles.

Figure 6:
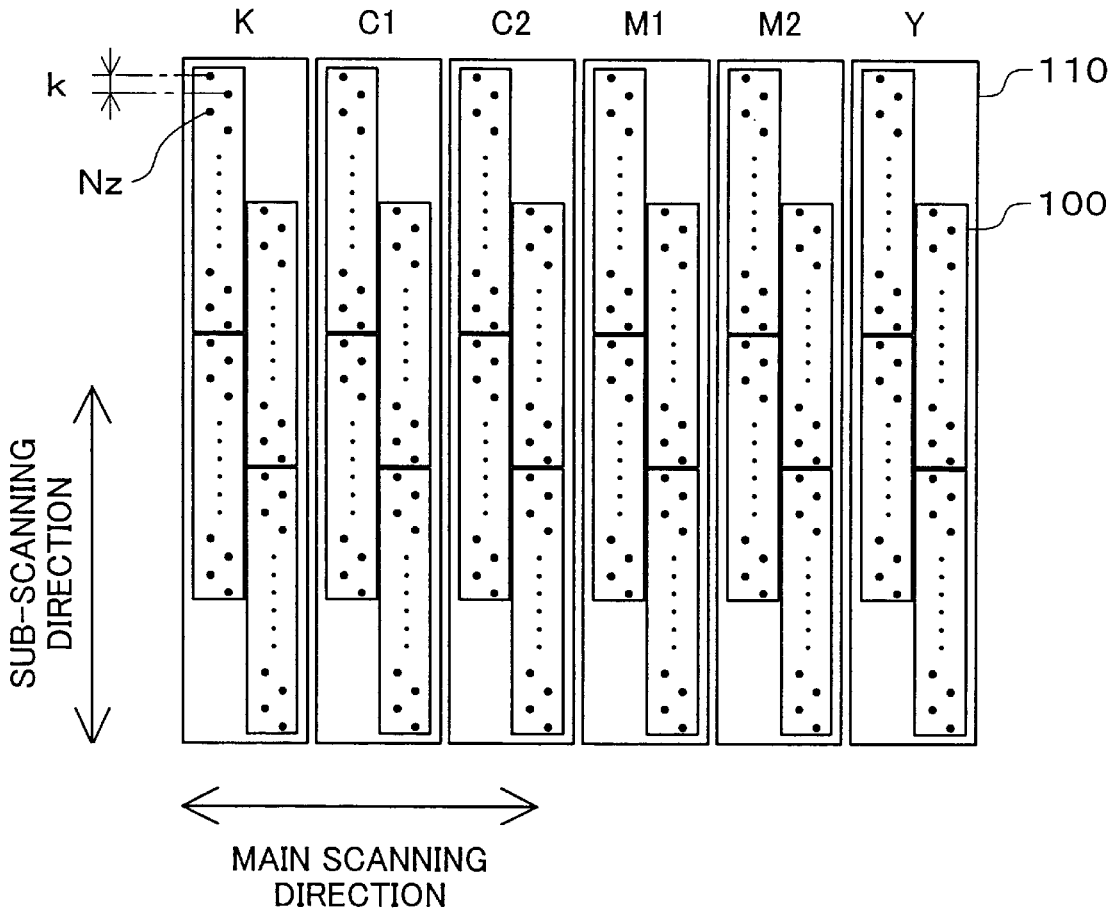
FIG. 6 shows an arrangement of a head assembly group, which includes a plurality of head assemblies arranged in a main scanning direction, used in the printer of the embodiment.

In another example shown in FIG. 6, a plurality of head assemblies for each color are combined in the main scanning direction to construct a head assembly group. In the example of FIG. 6, each nozzle unit 100 includes 320 nozzles (160 nozzles×2 columns) that are arranged in zigzag at a nozzle pitch k. Each head assembly 110 includes two nozzle units 100 aligned in the sub-scanning direction. A head assembly group 120 includes two head assemblies 110 combined in the main scanning direction. The structure of the nozzle unit causes each nozzle unit 100 to have the ink ejection characteristic varying in one period. The adjoining head assemblies in each head assembly group are thus shifted in position by a specific length, which is substantially equivalent to half the length of the nozzle unit in the sub-scanning direction.

Figure 7:
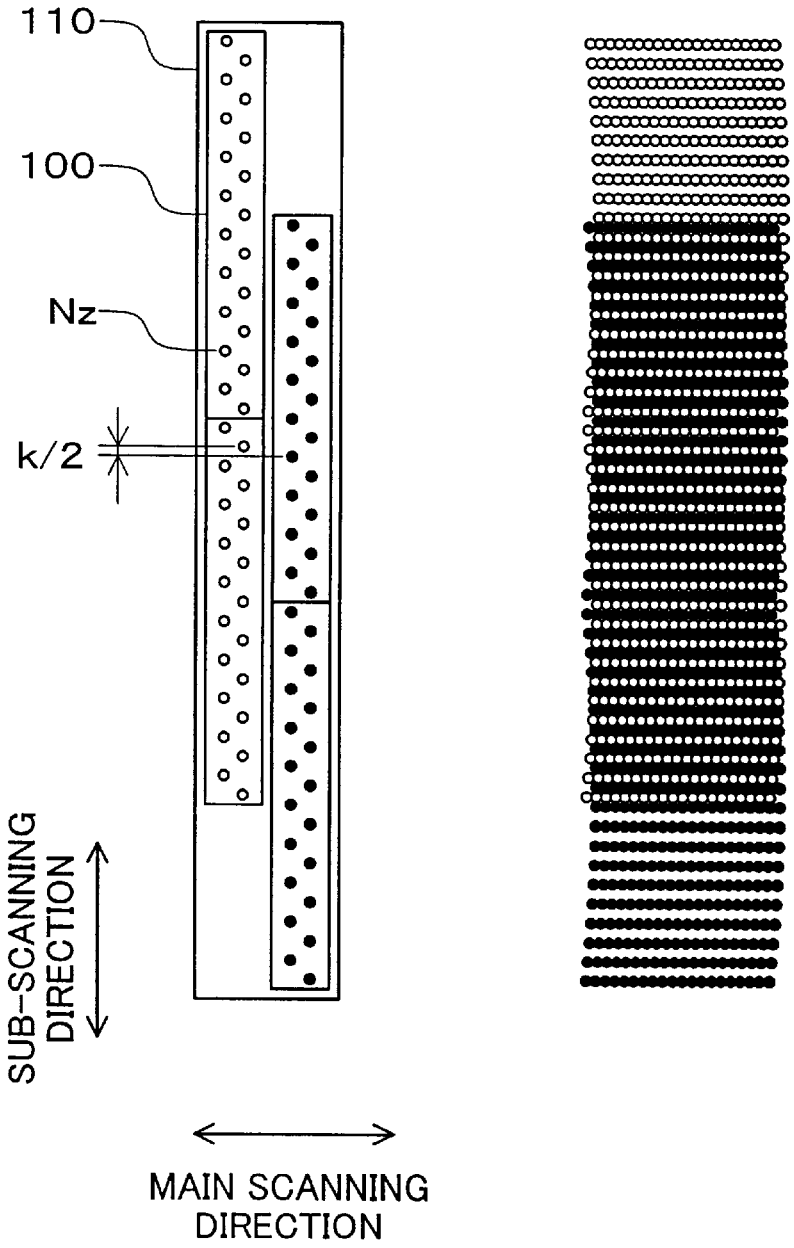
FIG. 7 conceptually shows a print of ink dots created by the head assembly group for one color on a printing medium.

FIG. 7 conceptually shows a print of ink dots created by the head assembly group. The left part of FIG. 7 shows the arrangement of the head assemblies for one color ink, and the right part of FIG. 7 conceptually shows a resulting print of ink dots created on the printing medium. The open circles represent the nozzles on the left head assembly and the resulting ink dots. The closed circles represent the nozzles on the right head assembly and the resulting ink dots. As shown in the drawing, the nozzles in the nozzle units 100 that adjoin to each other in the main scanning direction and are included in the different head assemblies are shifted in position by approximately half the nozzle pitch k. This practically forms a nozzle array having the nozzle pitch k/2. The adjoining head assemblies may alternatively be arranged to have identical nozzle positions in the main scanning direction.

In the color printer 20 having the hardware structure discussed above, the carriage motor 30 is driven to move the head assemblies 51 through 54 for the respective colors relative to the printing paper P in the main scanning direction. The sheet feed motor 35 is driven to feed the printing paper P in the sub-scanning direction. Under the control of the control circuit 60, while the main scan and the sub-scan of the carriage 40 are repeatedly carried out, the nozzles are driven at appropriate timings to eject ink droplets. The color printer 20 accordingly prints a color image on the printing paper.

B. Outline of Image Processing

Figure 8:
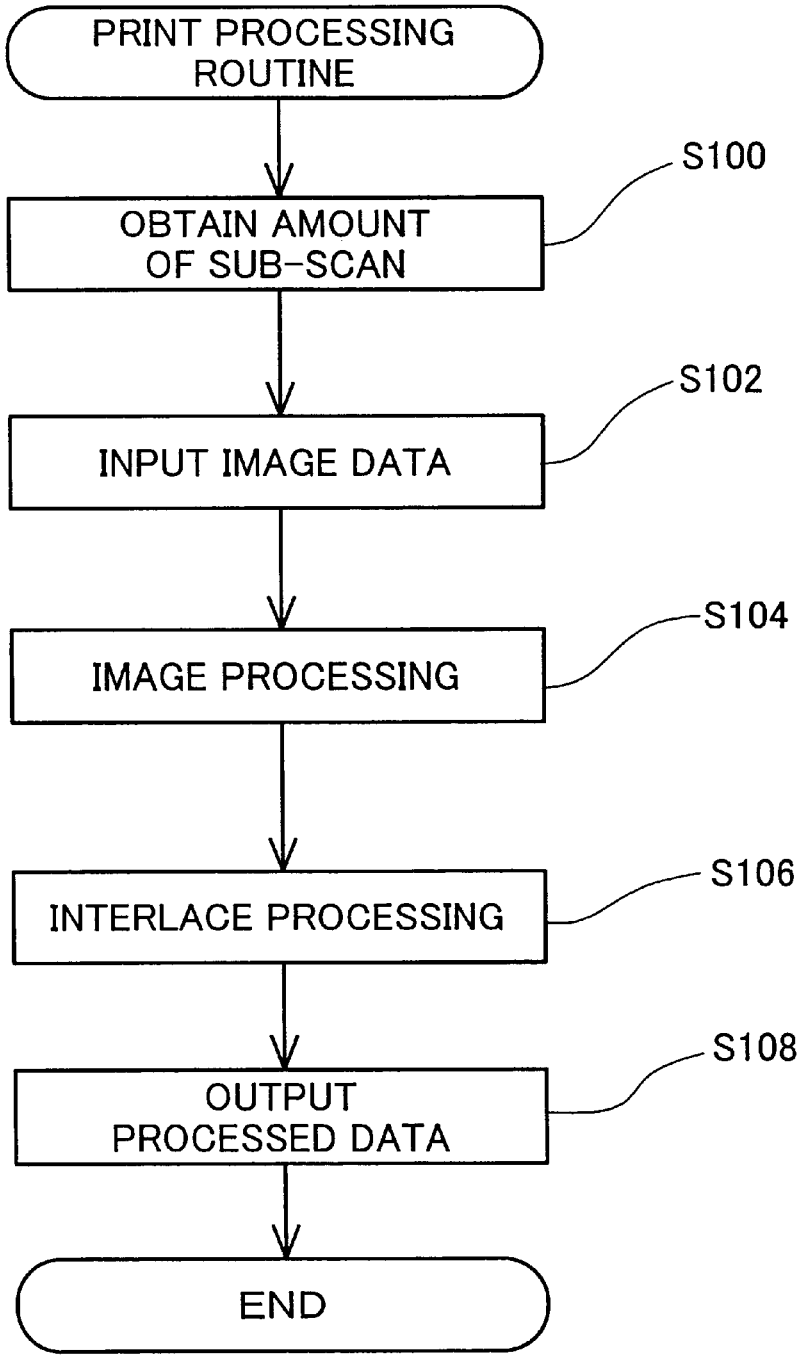
FIG. 8 is a flow chart showing a printing process routine executed in the embodiment.

As discussed above, the color printer 20 functions to receive the image data FNL and print a color image. The image data FNL supplied to the color printer 20 are generated through a predetermined series of image processing executed by the computer 80. FIG. 8 is a flowchart showing the outline of the series of processing executed by the computer 80 to output the image data FNL to the color printer 20 and print a color image. This series of processing is carried out in the printer driver 92 of the computer 80 by utilizing the respective functions of the CPU 81. The outline of the image processing is described below with referring to the flowchart of FIG. 8.

When the program enters the series of image processing shown in FIG. 8, the CPU 81 first obtains data regarding the amount of sub-scan of the head assembly for each color (step S100). As discussed later, for completion of interlace, the amount of sub-scan should be specified to fulfill predetermined conditions, which depend upon the nozzle pitch k and the number of nozzles. Preset amounts of sub-scan suitable for the structure of the head assembly are stored in advance in the ROM 82 of the computer 80. The process of step S100 reads the preset amounts of sub-scan from the ROM 82.

The CPU 81 subsequently inputs the image data (step S102). The image data are supplied from the application program 91 as described above with FIG. 2 and have 256 tones in the range of 0 to 255 for each of the colors R, G, and B with regard to the respective pixels constituting an image.

The CPU 81. receives the image data and carries out a predetermined series of image processing including conversion of the resolution, color conversion, and multi-thresholding, so as to convert the input image data to the final image data FNL printable by the color printer 20 (step S104). The concrete procedure converts the resolution of the input image into a printing resolution of the color printer 20 (conversion of the resolution), converts the expression by additive mixture of color stimuli using R, G, and B into the expression by subtractive mixture of color stimuli using C, M, Y, and K (color conversion), and then converts the image data having 256 tones into a dot on-off representation (multi-thresholding).

After completion of the above series of image processing, the CPU 81 starts an interlace process (step S106). The interlace process rearranges the image data, which has been converted to the dot on-off representation by the multi-thresholding included in the series of image processing, in a sequence of data to be transferred to the color printer 20. As mentioned previously, the color printer 20 drives the head assemblies 51 through 54 while repeatedly carrying out the main scan and the sub-scan of the carriage 40, thereby forming lines of dots (raster lines) on the printing paper P. As described above with FIG. 5, each of the head assemblies 51 through 54 for the respective colors includes the plurality of nozzles Nz. Each pass of the main scan forms a plurality of raster lines at intervals of the nozzle pitch k. The control procedure is accordingly required to form one set of plural raster lines at the intervals of the nozzle pitch k by each pass of the main scan, carry out sub-scan of the head assembly, and form another set of plural raster lines between the existing raster lines by a subsequent pass of the main scan. The sub-scan of the head assembly follows the amounts of sub-scan obtained at step S100. This control procedure causes the color printer 20 to actually create dots in a sequence different from the sequence of pixels on the image data. The interlace process is thus required to rearrange the image data.

On completion of the interlace process, the image data is output as the printable final image data FNL to the color printer 20 (step S108). The color printer 20 creates dots according to the image data FNL, so as to print an image on the printing paper.

In the color printer 20 of the embodiment, each head assembly is obtained by combining a plurality of nozzle units and is driven to print an image. As described previously, factors deteriorating the picture quality are present at each joint of the adjoining nozzle units of the head assembly. These picture quality-deteriorating factors are ascribed to, for example, the individual difference between adjoining nozzle units and the attachment error of the nozzle unit. When there is an error in feeding amount of sub-scan in the process of sub-scanning the head assembly, the picture quality-deteriorating factor arises in a specific part corresponding to the rear most end of the head assembly. In the color printer 20 of the embodiment, the head assembly is subjected to the sub-scan that does not allow any overlap of the printing positions corresponding to the joints of the adjoining nozzle units or the rear most end of the head assembly. This arrangement effectively prevents the picture quality-deteriorating factors from being accumulated to worsen the printing quality. The following describes the procedures applicable for the color printer 20 of the embodiment to complete the interlace and adequately carry out the sub-scan while preventing any overlap of the printing positions corresponding to the joints of the adjoining nozzle units or the rear most end of the head assembly, thereby preventing the significant deterioration of the printing quality. The description first regards the conditions to be fulfilled for completing the interlace and then the conditions with regard to the amount of sub-scan to be fulfilled for preventing the significant deterioration of the picture quality.

C. Conditions to Complete Interlace

Several known methods may be applicable to complete the interlace in a given structure of nozzles (the nozzle pitch k and the total number of nozzles). The simplest method sets a fixed value to the amount of sub-scan and completes each raster line by one pass of the main scan. There are two modified methods as applications of the simplest method. The first modified method completes each raster line by s passes of the main scan (hereinafter this method is referred to as the overlap method). This first modified method also uses a fixed value for the amount of sub-scan. The second modified method uses a combination of plural values for the amount of sub-scan (hereinafter this method is referred to as the irregular feeding method). The second modified method (the irregular feeding method) may be combined with the first modified method. Namely the amounts of sub-scan in the second modified method may be set to complete each raster line by one pass of the main scan or alternatively by s passes of the main scan. For convenience of explanation, the description first regards the conditions to complete the interlace in the simplest method and then the conditions to complete the interlace in the first modified method and in the second modified method.

C-1. Simplest Conditions to Complete Interlace

The following describes the conditions with regard to the amount of sub-scan to be fulfilled to complete the interlace in the case of setting of fixed value to the amount of sub-scan and completing each raster line by one pass of the main scan.

Figure 9:
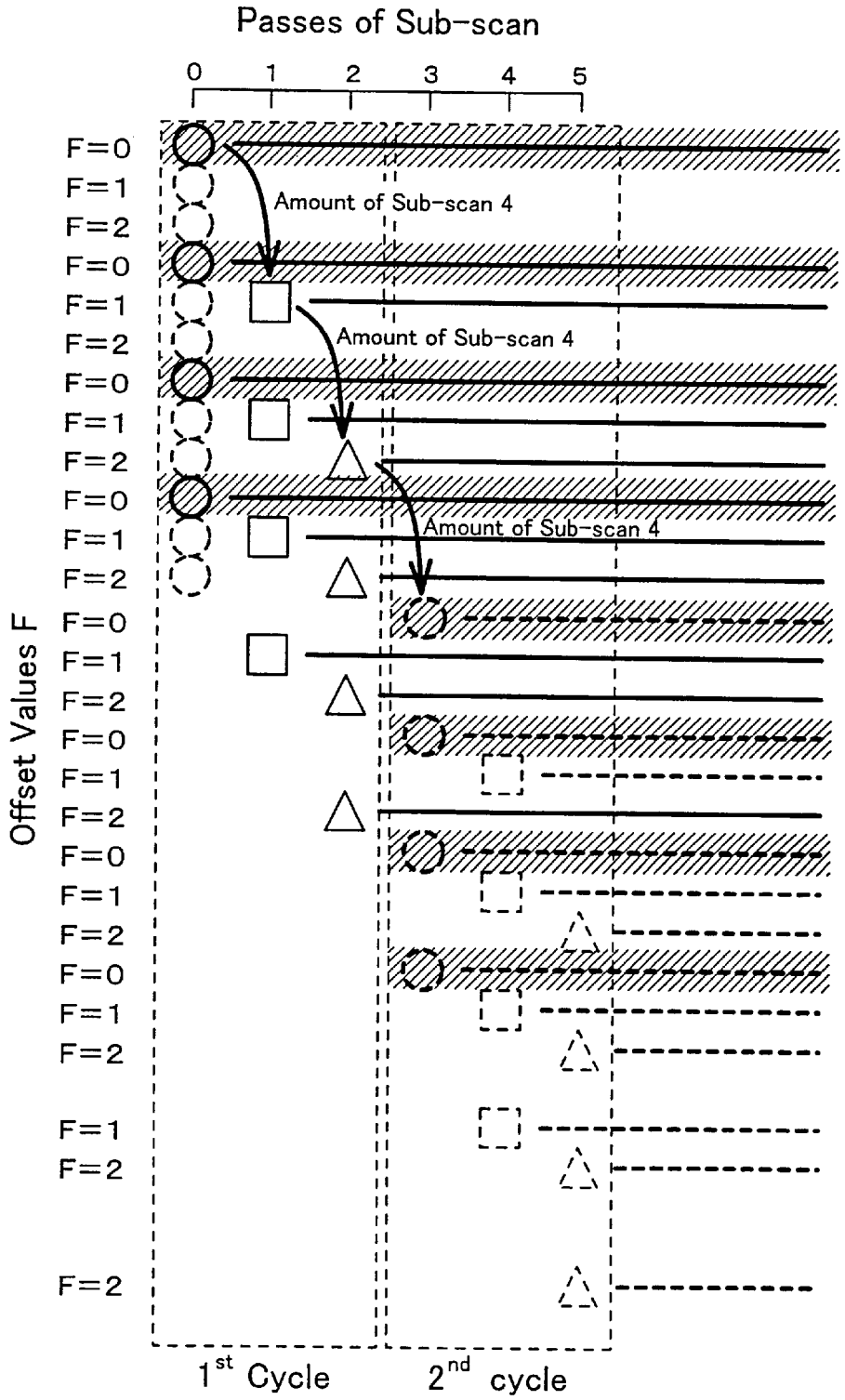
FIG. 9 shows conditions to complete the interlace at a fixed amount of sub-scan.

FIG. 9 shows conditions with regard to the amount of sub-scan L to complete the interlace in a given nozzle structure (the nozzle pitch k and the total number of nozzles N). The example of FIG. 9 adopts the simple nozzle structure where the number of nozzles N=4 and the nozzle pitch k=3 (dots) and selects a fixed amount of sub-scan L=4 (raster lines) (in the description below, the respective units are omitted). The circles on the left most column represent the positions of the head dots on raster lines formed by a first pass of the main scan. The lines extending rightward from the circles represent raster lines filled with the dots. In this example, since the nozzle pitch is equal to 3, there is a space for two raster lines to be subsequently formed, between each pair of existing raster lines. In the specification hereof, such raster lines are called phantom raster lines. The offset value F of each phantom raster line to the existing raster line formed by the first pass is either 1 or 2 as shown in FIG. 9. Namely all the raster lines are classified into three groups, that is, those having the offset value F=0 (the raster lines formed by the first pass), those having the offset value F=1, and those having the offset value F=2.

The squares represent the positions of the head dots on raster lines formed after a first pass of the sub-scan under the condition of the fixed amount of sub-scan L=4. Here the description regards the conditions to complete the interlace. Significance is accordingly given to the positions of the respective raster lines in the sub-scanning direction, and the positions of the raster lines in the main scanning direction are not important here. In the illustration of FIG. 9, for the purpose of clarity, the starting positions of the raster lines are shifted slightly in the main scanning direction. The dots expressed by the squares are accordingly located on the right side of the dots expressed by the circles in the example of FIG. 9. In such illustration, the starting position of each raster line shows how many passes of the sub-scan have been carried out prior to formation of the raster line.

As clearly understood from the illustration of FIG. 9, all the raster lines formed after the first pass of the sub-scan have the offset value F=1. The triangles represent the positions of the head dots on raster lines formed after a second pass of the sub-scan. Since the starting positions of the raster lines are shifted in the main scanning direction, the dots expressed by the triangles are located on the right side of the dots expressed by the squares in the example of FIG. 9. All the raster lines formed after the second pass of the sub-scan have the offset value F=2. The raster lines are formed at the positions of the offset value F=0 after a third pass of the sub-scan. The positions of the head dots on these raster lines are expressed by the dotted circles, which are located on the right side of the array of dots expressed by the triangles. Here it is assumed that one group consists of four raster lines formed by the first pass of the main scan, and the other group consists of four raster lines formed by the third pass of the main scan. There are no phantom raster lines having the offset value F=0 between these two groups, nor any raster lines formed in an overlapping manner. Namely a group of raster lines formed after the third pass of the sub-scan follows the group of raster lines formed by the first pass of the main scan.

Raster lines are successively formed at the positions having the offset value F=1 after another pass of the sub-scan and at the positions having the offset value F=2 after a further pass of the sub-scan. With regard to the raster lines at the positions having the offset value F=0, a new group of raster lines currently formed always follows an existing group of raster lines previously formed. The procedure of repeating the set of first through third formation of the raster lines as one cycle enables the raster lines to be formed continuously without leaving any phantom raster lines, and eventually causes no overlap or dropout of the raster lines.

The simplest conditions, that is, the conditions to complete the interlace when the amount of sub-scan is set to a fixed value and each raster line is completed by one pass of the main scan, are introduced as discussed below with the example of FIG. 9.

When the number of nozzles =N and the nozzle pitch =k, N raster lines are formed by a first pass of the main scan, and there are (k−1) phantom raster lines between the existing raster lines adjacent to each other. The phantom raster lines are classified into (k−1) different types having different offset values F in the range of 1 to (k−1). Every set of the pass of the sub-scan and the pass of the main scan enables the raster lines to be formed at the positions having an identical offset value. The (k−1) passes of the sub-scan and the (k−1) passes of the main scan are thus required to form the raster lines at all the positions of the phantom raster lines.

The process of successively forming the raster lines may be understood in the following manner. In the case of the nozzle pitch k, the first pass of the main scan actually forms N raster lines while causing (k−1) different types of phantom raster lines. Every subsequent set of the pass of the sub-scan and the pass of the main scan actually forms raster lines at positions of one type of phantom raster lines. The process of repeating the (k−1) passes of the sub-scan and the (k−1) passes of the main scan fills all the positions of the phantom raster lines and concludes one cycle. After conclusion of one cycle, the first pass of the main scan again causes (k−1) different types of phantom raster lines. The process of repeating the (k−1) passes of the sub-scan and the (k−1) passes of the main scan again forms raster lines at all the positions of the phantom raster lines. The procedure completes printing an image when all the raster lines included in the effective area on the printing medium are formed in this manner.

In order to form the raster lines without any dropout, the cycle should be repeated without any intermission. As clearly understood from the example of FIG. 9, the required condition for the continuous repetition is that the number of raster lines advanced by the k passes of the sub-scan is the product of the number of nozzles N and the nozzle pitch k as expressed below, where L denotes the amount of sub-scan for each pass:

$$(k \text{ times}) \times (\text{amount of sub-scan } L) = (\text{number of nozzles } N) \times (\text{nozzle pitch } k)$$

This equation shows that the amount of sub-scan L for each pass should be equal to the number of nozzles N.

In order to form raster lines at all the positions of phantom raster lines without any overlap by the (k−1) passes of the sub-scan, it is required that the amount of sub-scan L and the nozzle pitch k are prime to each other. As long as L and k are prime to each other, the first to the (k−1)-th passes of the sub-scan give different offset values in the range of 1 to (k−1) without any overlap. This is easily understood from the following explanation.

Here it is assumed that the offset value is equal to 'c' after 'a' passes of the sub-scan. In this case, there is an integer a satisfying $(L \times a) = (\alpha \times k) + c$. In a similar manner, when it is assumed that the offset value is again equal to 'c' after 'b' passes of the sub-scan, there is an integer β satisfying $(L \times b) = (\beta \times k) + c$. The difference between these two equations gives $(a \cdot b) \times L = (\alpha \cdot \beta) \times k$. Here L and k are prime to each other, so that the least common multiple of L and k is L×k. This is inconsistent with this equation. The offset value after the 'a' passes of the sub-scan and the offset value after the 'b' passes of the sub-scan do not accordingly take any identical value 'c'. Namely as long as L and k are prime to each other, the first to the (k−1)-th passes of the sub-scan give different offset values in the range of 1 to (k−1) without any overlap.

Based on the above discussion, the simplest conditions to complete the interlace where each raster line is completed by one pass of the main scan at a fixed amount of sub-scan are 'the number of nozzles N and the nozzle pitch k are prime to each other and the amount of sub-scan L is equal to the number of nozzles N'.

C-2. Conditions to Complete Interlace in First modified method (Overlap)

The first modified method completes each raster line by 's' passes of the main scan at a fixed amount of sub-scan. This method enables another nozzle to carry out supplementary work in the event that one nozzle has some abnormality and can not form raster lines normally, thus minimizing the expected deterioration of the picture quality. In the description hereinafter, the number of passes of the main scan required to complete each raster line is referred to as the overlap number.

The concept adopted in the case of completing each raster line by one pass of the main scan is basically applicable for the case of the overlap number 's' (where 's' is an integer of not less than 2). Here it is assumed that the number of nozzles=N and the nozzle pitch=k. Immediately after the first pass of the main scan, there are incomplete N raster lines and (k−1) phantom raster lines between each pair of the incomplete raster lines. In this case, all the raster lines are classified into k different types of raster lines having different offset values in the range of 0 to k. When the overlap number s=2 (that is, when each raster line is completed by two passes of the main scan), one cycle consists of 2k passes of the sub-scan. This is just double the number of passes of the sub-scan in the case of s=1.

In order to complete the interlace, it is required not only to conclude each cycle but to make the respective concluded cycles continuous without any interval. For example, a new group of raster lines having the offset value F=0 formed in each cycle should follow an existing group of raster lines having the offset value F=0 formed in a previous cycle. One cycle consists of s×k passes of the sub-scan, and the amount of sub-scan for each pass is equal to L. The condition to make the respective concluded cycles continuous is that the number of raster lines advanced by one cycle, that is, s×k is equal to (the number of nozzles N)×(the nozzle pitch k). Namely it is required that the amount of sub-scan L=(the number of nozzles N)/s. Setting this condition for the sub-scan enables each of the k different types of raster lines to be completed by s passes of the main scan. The procedure then forms raster lines without any overlap or dropout to complete the interlace. The effective number of raster lines (N/s) represents the net number of raster lines actually formed by each pass of the main scan at the overlap number s. The simplest case discussed above may be regarded as the special case of the first modified method at s=1.

C-3. Conditions to Complete Interlace in Second Modified Method (Irregular Feeding)

The second modified method (irregular feeding) uses a set of plural predetermined amounts of sub-scan. The condition to complete the interlace at a fixed amount of sub-scan is that the effective number of raster lines (N/s) and the nozzle pitch k should be prime to each other. It is, however, not so easy to satisfy this condition. In some cases, the required prime relation is fulfilled by killing some of the nozzles mounted on the nozzle unit. This method does not effectively use all the nozzles and thus undesirably lowers the printing speed. The sub-scan according to the irregular feeding method discussed below enables the interlace to be completed even when the effective number of raster lines (N/s) is not prime to the nozzle pitch k, thus desirably preventing the decrease in printing speed.

The following discussion shows that the irregular feeding method is one modification of the above method at the fixed amount of sub-scan. Here it is assumed that the number of nozzles=N, the nozzle pitch=k, and the overlap number s=1 for the simplicity of explanation. The first pass of the main scan actually forms N raster lines while causing (k−1) different types of phantom raster lines between each pair of the existing raster lines. In order to form raster lines at all the positions of the phantom raster lines, the (k−1) passes of the sub-scan are required, regardless of the feeding method of sub-scan. In the case of irregular feeding, k passes of the sub-scan are required to complete one cycle including the raster lines formed by the first pass of the main scan. Since it is also required to make the respective cycles continuous, the relationship of (the number of raster lines advanced by one cycle)=(the number of nozzles N)×(the nozzle pitch k) is held in the case of irregular feeding. The irregular feeding method does not use a fixed amount of sub-scan for each pass but selects a set of amounts of sub-scan to form raster lines at all the positions of the phantom raster lines. This point is only the difference between the irregular feeding method and the regular feeding method that applies a fixed amount of sub-scan for each pass. Namely the conditions in the case of irregular feeding are obtained by excluding the fixed amount of sub-scan for each pass from the conditions discussed above.

Based on the above discussion, the interlace is completed in the case of irregular feeding by selecting a set of amounts of sub-scan that fulfill the following conditions:

[Condition 1] One cycle consists of k passes of sub-scan;

[Condition 2] The sum of the feeding amounts or the amounts of sub-scan in one cycle is equal to N×k; and

[Condition 3] All the offset values in the range of 1 to (k−1) appear once in one cycle, where N and k respectively denote the number of nozzles and the nozzle pitch and s=1.

In one concrete example of irregular feeding, it is assumed that the number of nozzles N=8, the nozzle pitch k=4, and s=1. Here the number of nozzles N and the nozzle pitch k are not prime to each other. A set of values {10,7,6,9} is selected as the set of amounts of sub-scan that fulfill [Condition 1] and [Condition 2] given above. The raster lines formed after the first pass of the sub-scan have the offset value F=2 as mod(10,4)=2. Here mod is a remainder operator and mod(a,b) gives a remainder when a is divided by b. After the second pass of the main scan, the total amount of sub-scan is equal to 17, so that the offset value F=1 as mod(17,4)=1. In a similar manner, after the third pass of the main scan, the offset value F=3 as mod(23,4)=3. All the offset values 1 through 3 appear once in one cycle. This set of amounts of sub-scan accordingly fulfills [Condition 3] given above.

Figure 10:
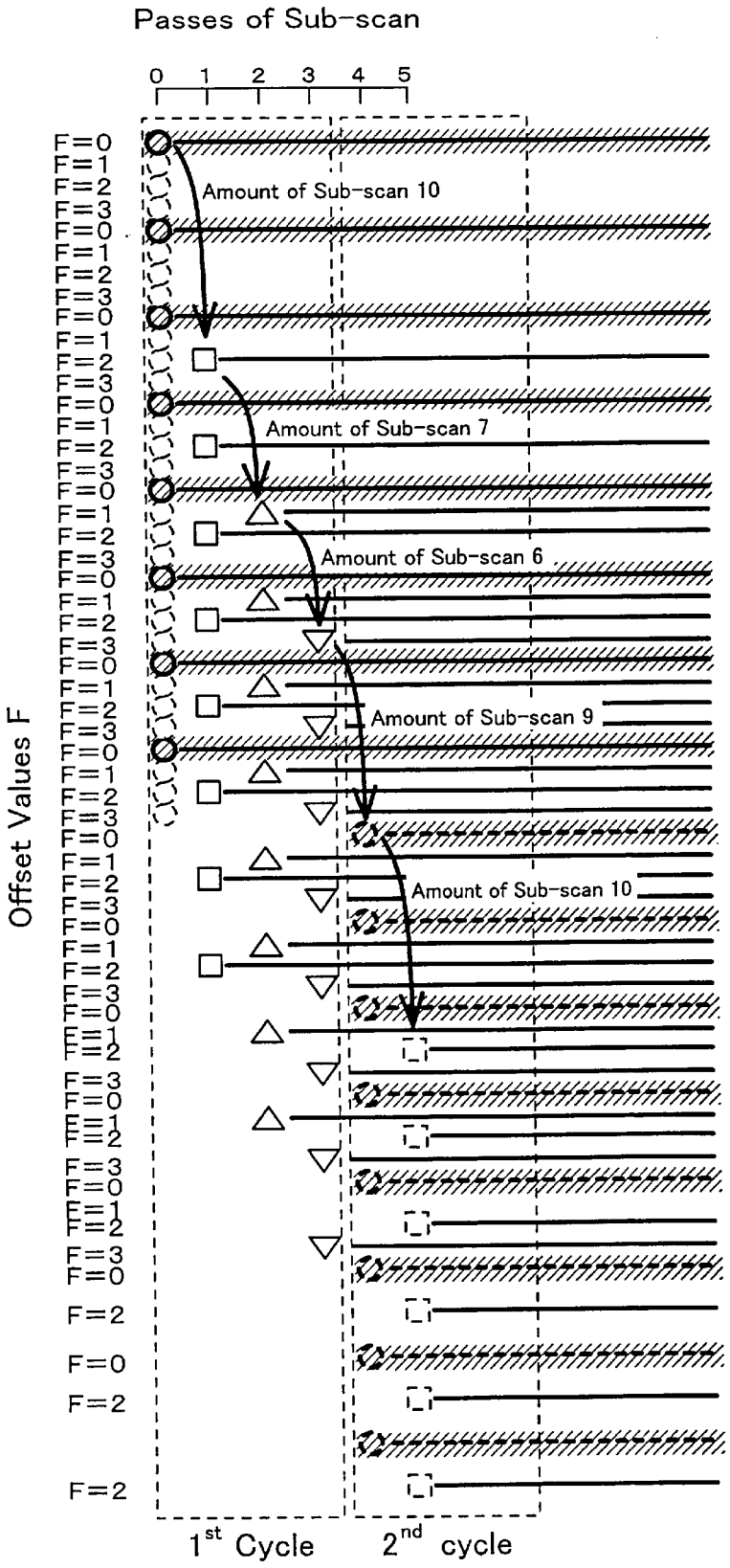
FIG. 10 shows conditions to complete the interlace in the case of irregular feeding with a plurality of different amounts of sub-scan.

FIG. 10 shows a process of forming raster lines in the case of irregular feeding with this selected set of amounts of sub-scan. As in the illustration of FIG. 9, the circles represent the positions of head dots on raster lines, and the lines extending rightward represent the raster lines. As clearly shown in FIG. 10, raster lines are formed at all the positions of the phantom raster lines after the third passes of the sub-scan, and the fourth pass of the sub-scan starts a new cycle. The raster lines formed after the fourth pass of the sub-scan follow the raster lines formed in the previous cycle. The procedure of repeating this cycle ensures formation of raster lines without any overlap or dropout.

It is possible to complete each raster line by 's' passes of the main scan with the irregular feeding. The conditions to attain the irregular feeding are equivalent to the first modification from the simplest conditions. Namely the interlace is completed by selecting a set of amounts of sub-scan that fulfill the following conditions:

[Condition 1'] One cycle consists of s×k passes of sub-scan;

[Condition 2'] The sum of the feeding amounts or the amounts of sub-scan in one cycle is equal to N×k; and

[Condition 3'] All the offset values in the range of 1 to (k−1) appear s times in one cycle, where N and k respectively denote the number of nozzles and the nozzle pitch.

D. Arrangements Applicable for Sub-scan of Head Assembly in Color Printer of Embodiment The color printer 20 of the embodiment uses the head assembly, which is obtained by combining a plurality of nozzle units, like an integral print head and carries out the main scan and the sub-scan of the head assembly to print an image on the printing medium. The overlap of the printing positions corresponding to the joints of any adjoining nozzle units or the overlap of the printing positions corresponding to the rear most end of the head assembly and the joint of any adjoining nozzle units results in accumulation of the picture quality-deteriorating factors at the corresponding positions. Such accumulation extremely worsens the picture quality. In order to prevent deterioration of the picture quality, as discussed above, the color printer 20 of the embodiment selects an appropriate amount of sub-scan or an appropriate set of amounts of sub-scan in such a manner that the printing positions corresponding to the joints of any adjoining nozzle units do not overlap each other and that the printing positions corresponding to the rear most end of the head assembly and the joint of any adjoining nozzle units do not overlap each other. The color printer 20 then carries out the sub-scan of the head assembly according to the selected amount of sub-scan or the selected set of amounts of sub-scan while completing the interlace. A plurality of arrangements are applicable to select the appropriate amount of sub-scan or the appropriate set of amounts of sub-scan as discussed below.

D-1. First Arrangement

A first arrangement applicable to the color printer 20 of the embodiment uses a head assembly including a plurality of identical nozzle units. In this arrangement, the amount of sub-scan is selected to fulfill the conditions discussed below. In the case where such an amount of sub-scan is non-selectable, the specification of the nozzle unit or the number of nozzle units should be changed.

Figure 11:
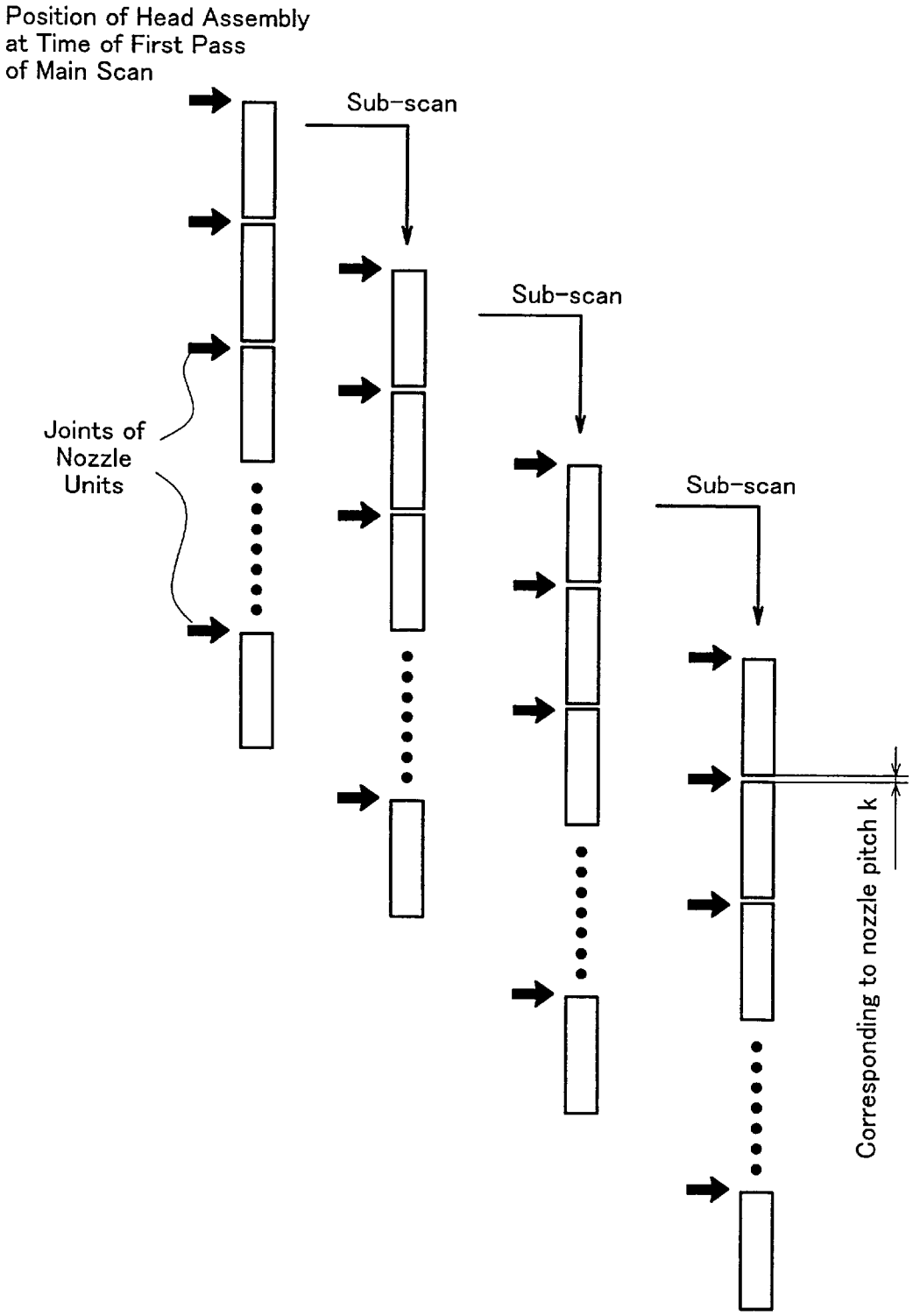
FIG. 11 shows conditions to prevent deterioration of the picture quality in a head assembly that is obtained by arranging a plurality of identical nozzle units at a fixed amount of sub-scan.

On the premises of the nozzle pitch k and the overlap number s, it is assumed that each nozzle unit includes n nozzles and one head assembly includes M nozzle units. Namely one head assembly has the function equivalent to that of an integral large-sized print head having the total number of nozzles M×n×s and the nozzle pitch k. As described above, in this case, the arrangement of satisfying (n/s)≧k effectively prevents any overlap of the printing positions corresponding to the joints of the adjoining nozzle units as well as any overlap of the printing positions corresponding to the rear most end of the head assembly and the joint of the adjoining nozzle units. The following describes the reason of such prevention with reference to FIG. 11.

When the head assembly consists of M nozzle units, there are (M−1) joints of the adjoining nozzle units, that is, M parts of the picture quality-deteriorating factors including the rear most end of the head assembly. Each pass of the main scan forms M parts of the picture quality-deteriorating factors, while each pass of the sub-scan causes another M parts of the picture quality-deteriorating factors to appear at different positions. When the nozzle pitch=k and the overlap number=s, one cycle consists of k×s passes of the sub-scan. There are accordingly M×k×s parts of the picture quality-deteriorating factors in one cycle. In the first arrangement, the amount of sub-scan is fixed to an identical value and the conditions to complete the interlace are fulfilled. Such parts are thus not localized but distributed homogeneously. Each joint of the adjoining nozzle units corresponds to the nozzle pitch and accordingly has the width of k raster lines. Namely the parts of the picture quality-deteriorating factors appearing in one cycle correspond to M×k×k×s raster lines.

The head assembly may be regarded as a nozzle unit having the number of nozzles M×n and the nozzle pitch k. The total amount of sub-scan in one cycle accordingly corresponds to M×n×k raster lines. The parts of the picture quality-deteriorating factors corresponding to M×k×k×s raster lines are present in a homogeneously dispersing manner in one cycle, that is, in the area of M×n×k raster lines. In order to avoid the overlap of any such parts of the picture quality-deteriorating factors, the relationship of M×n×k≧M×k×k×s should be fulfilled. Namely the arrangement of fulfilling n≧k×s allows the sub-scan without causing any overlap of the printing positions corresponding to the joints of the adjoining nozzle units as well as any overlap of the printing positions corresponding to the rear most end of the head assembly and the joint of the adjoining nozzle units.

Figure 12:
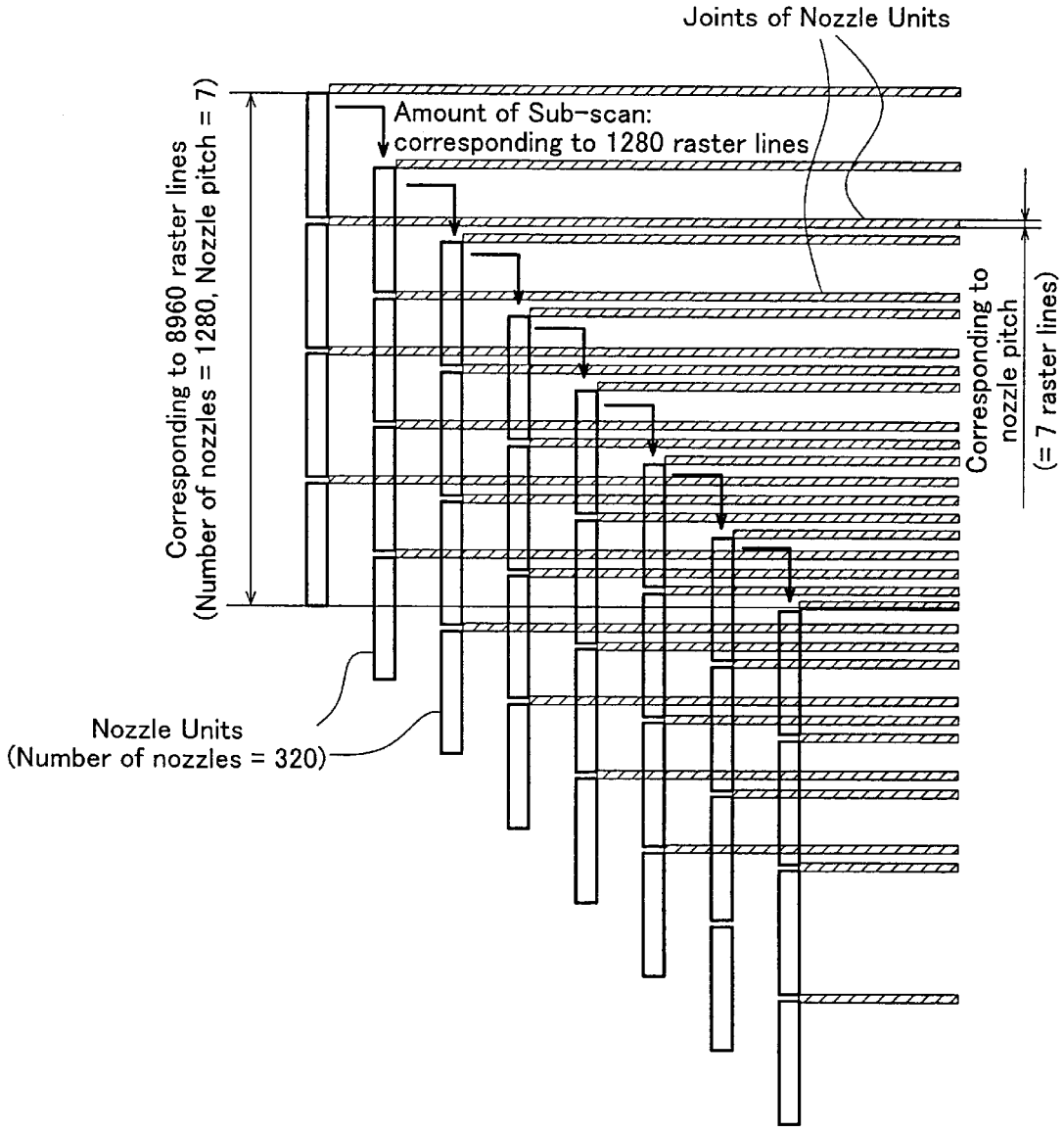
FIG. 12 shows one example of preventing deterioration of the printing quality in a first arrangement.

The fact that the arrangement of fulfilling (n/s)≧k allows the sub-scan without causing any overlap, for example, of the printing positions corresponding to the joints of the nozzle units is confirmed with a concrete example. In the color printer 20 of the embodiment, four nozzle units, each having 320 nozzles, are combined and assembled to construct each of the head assemblies for the respective colors (see FIG. 5). Each head assembly accordingly has 1280 nozzles. In the case of the overlap number s=1, the number of effective raster lines is equal to 1280. In order to complete the interlace at a fixed amount of sub-scan, the nozzle pitch k should be an integer prime to the value 1280. Here it is assumed that k=7. In this case, the number of nozzles per nozzle unit n=320, the overlap number s=1, and the nozzle pitch k=7. These values satisfy the relationship of n≧k×s. FIG. 12 shows one example of sub-scanning the head assembly of this structure. The total number of nozzles in the head assembly is equal to 1280 and the nozzle pitch k=7. The interlace is accordingly completed by seven passes of the sub-scan, each corresponding to 1280 raster lines. In the illustration of FIG. 12, for the purpose of clarity, the positions corresponding to the joints of the adjoining nozzle units are shown by the thick lines. The illustration of FIG. 12 clearly shows that the sub-scan of the head assembly by one cycle does not cause any overlap of the printing positions corresponding to the joints of the nozzle units or corresponding to the rear most end of the head assembly and the joint of the nozzle units.

D-2. Second Arrangement

Figure 13A:
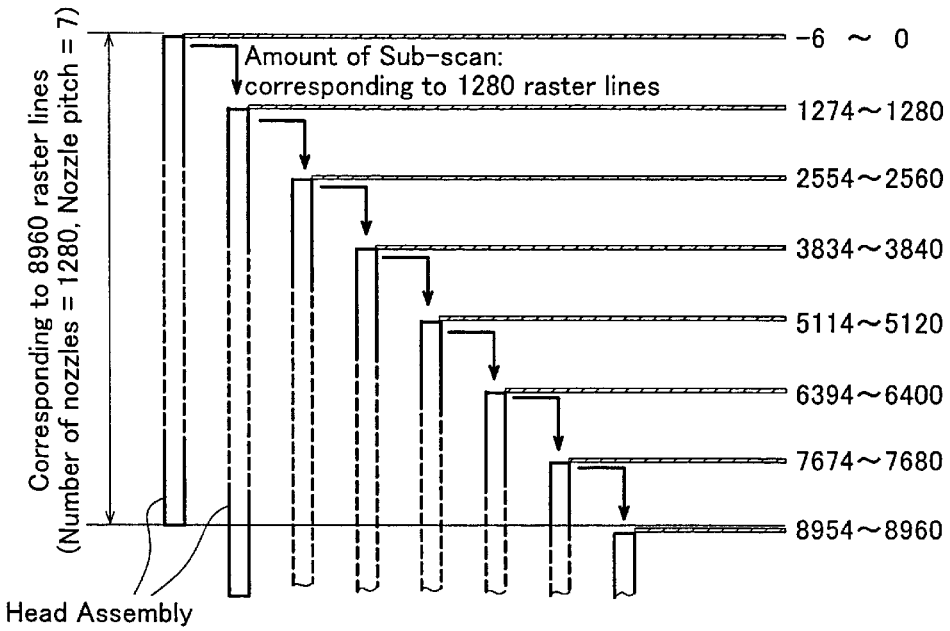
FIGS. 13A–B shows a process of specifying the dividing positions on the head assembly to prevent deterioration of the printing quality in a second arrangement.
Figure 13B:
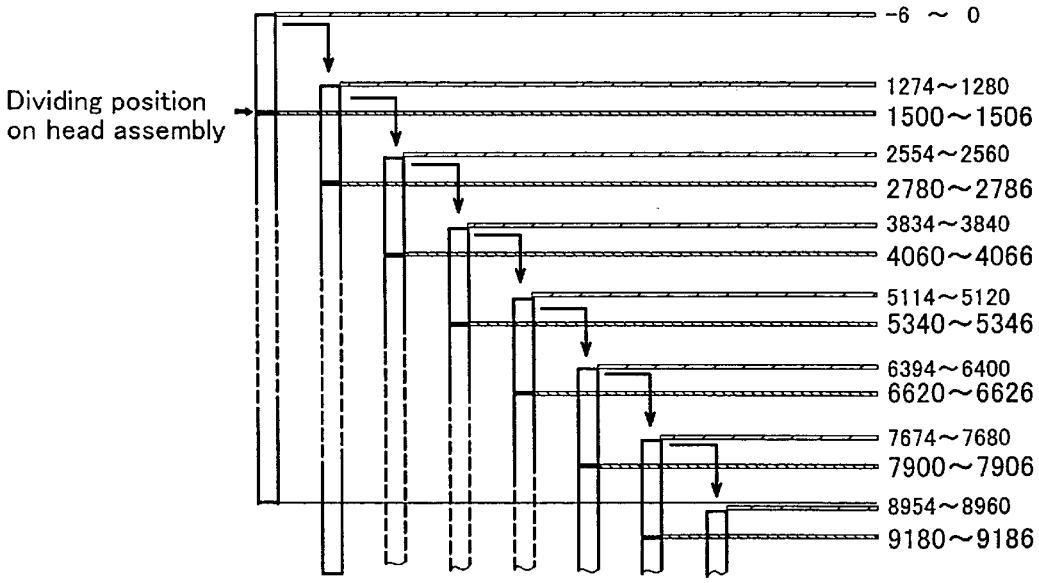

A second arrangement applicable to the color printer 20 of the embodiment uses a head assembly including a plurality of different nozzle units. This arrangement specifies the dividing positions on the head assembly, in order to prevent any overlap of the printing positions corresponding to the joints of the adjoining nozzle units in the course of the sub-scan of the head assembly. The following describes a process of specifying the dividing positions on the head assembly, which has the same nozzle configuration as that of the first arrangement. FIG. 13 shows the process of specifying the dividing positions on the head assembly having the nozzle configuration identical with that of the first arrangement, that is, the head assembly having the total number of nozzles=1280 and the nozzle pitch k=7.

FIG. 13(*a*) shows the state of sub-scan of the non-divided head assembly at a fixed amount. In this stage, there are no joints of the nozzle units on the head assembly, so that only the rear most end of the head assembly has the picture quality-deteriorating factors. One pass of the sub-scan of the head assembly moves the part of the picture quality-deteriorating factors from the area corresponding to the rear most end of the head assembly to the area of the $1274^{th}$ to $1280^{th}$ raster lines. Here the part of the picture quality-deteriorating factors has the width corresponding to the nozzle pitch. Another pass of the sub-scan moves the part of the picture quality-deteriorating factors to the area of the $2554^{th}$ to $2560^{th}$ raster lines. In the illustration of FIG. 13(*a*), each range of raster line numbers represents the area to which the rear most end of the head assembly is moved by each pass of the sub-scan.

FIG. 13(*b*) shows the state where one dividing position is specified on the head assembly. The overlap of the area corresponding to the rear most end of the head assembly (see FIG. 13(*a*)) with the dividing position on the head assembly causes accumulation of the picture quality-deteriorating factors and significantly worsens the printing quality. The dividing position is accordingly set not to overlap with this area. In the example of FIG. 13(*b*), the head assembly is divided at the position corresponding to the area of the $1500^{th}$ to $1506^{th}$ raster lines. The dividing position of the head assembly may be set arbitrarily as long as the dividing position does not overlap with the rear most end of the head assembly. Specifying one dividing position or the position of one joint of the adjoining nozzle units determines the areas where the joint of the nozzle units appears in the course of the sub-scan. In the example of FIG. 13(*b*), the joint of the nozzle units appears, for example, in the area corresponding to the $2780^{th}$ to $2786^{th}$ raster lines and in the area corresponding to the $4060^{th}$ to $4066^{th}$ raster lines. Both the position corresponding the rear most end of the head assembly and the position corresponding to the joint of the nozzle units appear at a fixed period equal to the amount of sub-scan. The method of specifying the first dividing position on the head assembly not to overlap with the areas where the rear most end of the head assembly appears effectively prevents any overlap of the printing position corresponding to the rear most end of the head assembly with the printing position corresponding to the joint of the nozzle units in any pass of the sub-scan. The smaller-sized numbers on the right end of FIG. 13(*b*) represent the raster lines in the areas where the rear most end of the head assembly appears. The larger-sized numbers represent the raster lines in the areas where the joint of the adjoining nozzle units appears.

Any new dividing position should be specified to overlap with neither the areas where the rear most end of the head assembly appears nor the areas where the already specified dividing positions appear by referring to the example of FIG. 13(*b*). This method easily determines the arrangement of the nozzle units that does not worsen the printing quality. Application of this arrangement enables the head assembly to be designed by combining a plurality of available different nozzle unit, thus significantly enhancing the degree of freedom in design.

D-3. Third Arrangement

Figure 14:
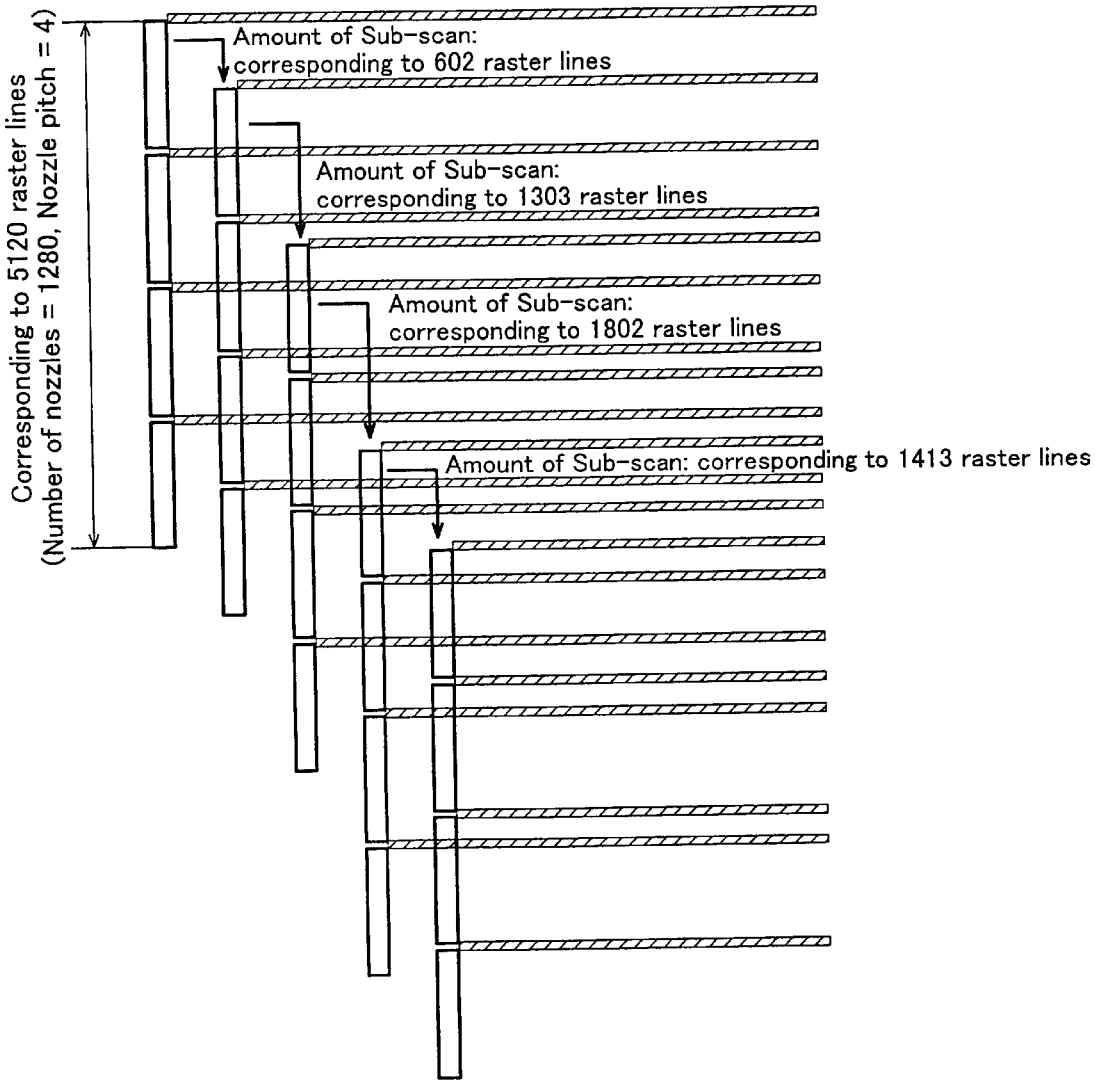
FIG. 14 shows one example of preventing deterioration of the printing quality in a third arrangement.
Figure 15:
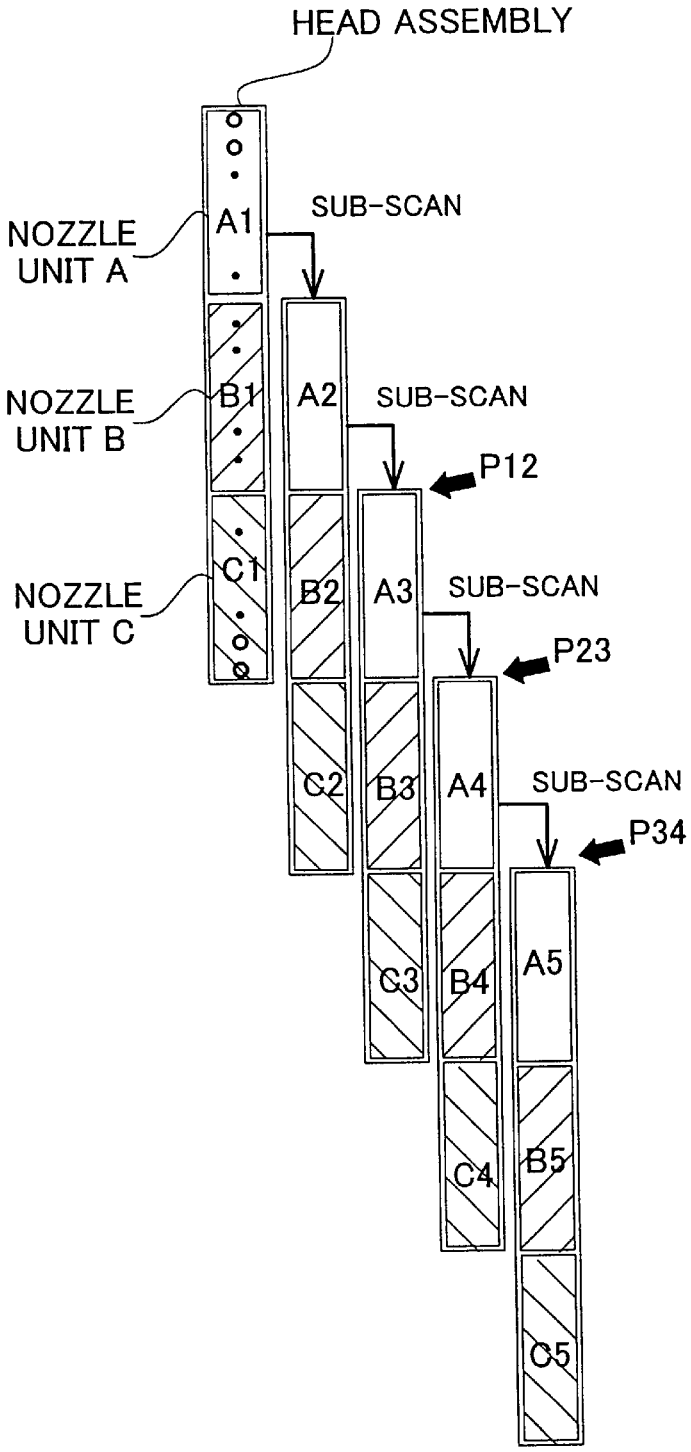
FIG. 15 conceptually shows the reason for the deteriorating picture quality in the case of sub-scan that causes overlaps of printing positions corresponding to joints of nozzle units.
Figure 16:
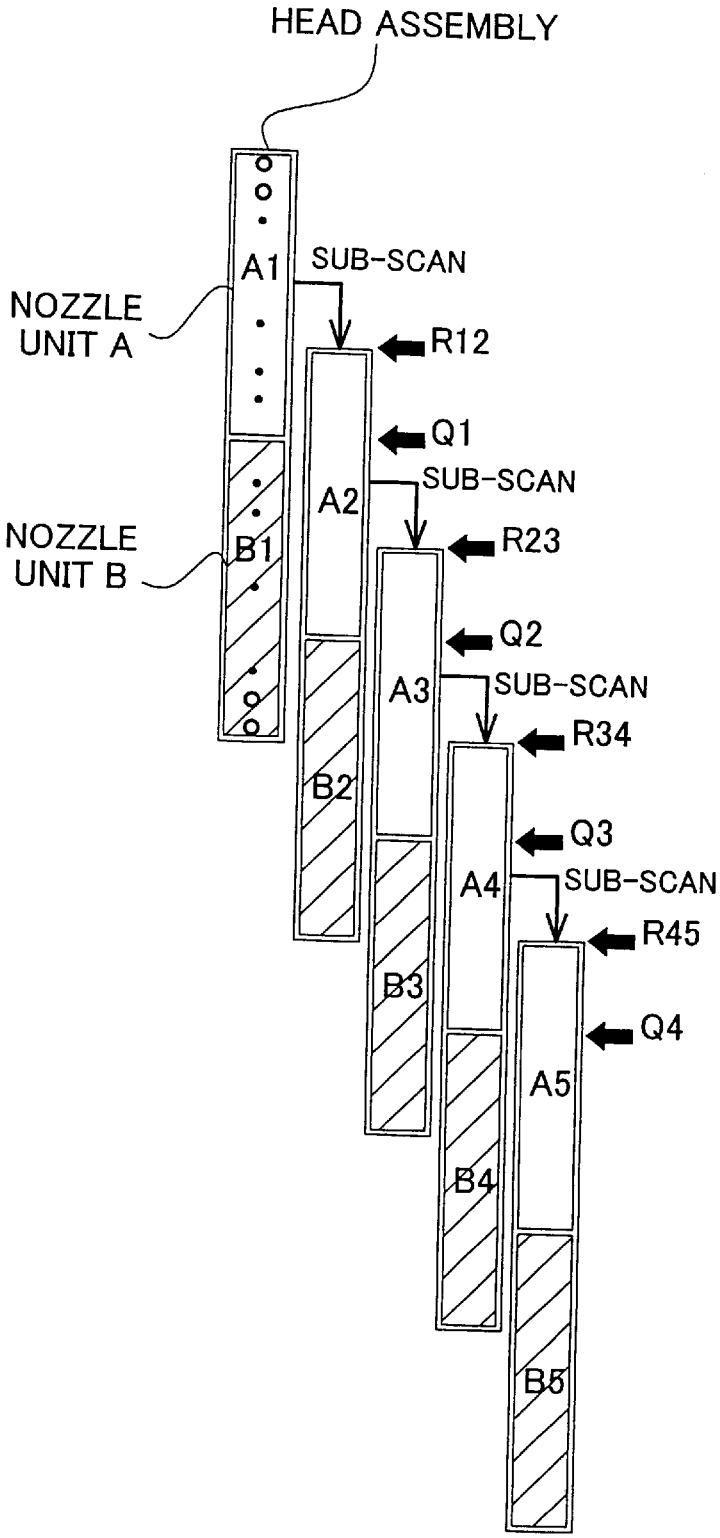
FIG. 16 shows one example of sub-scan that avoids any overlap of printing positions corresponding to joints of nozzle units.
Figure 17A:
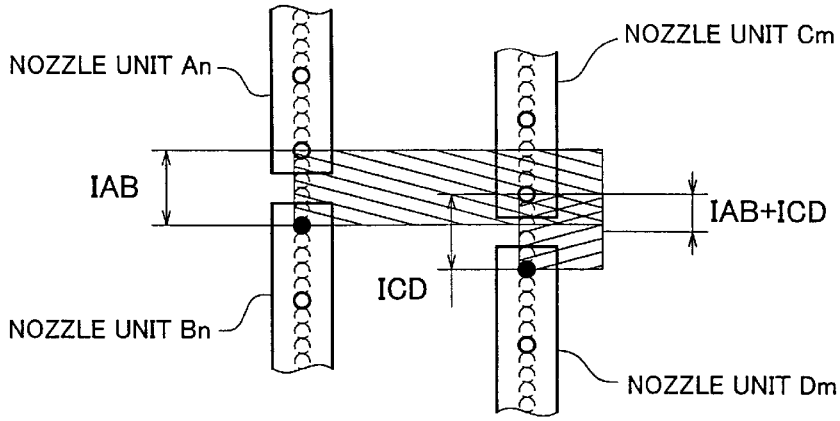
FIGS. 17A–C are an enlarged view showing the joint between nozzle units A and B in an n-th pass of the main scan and the joint between nozzle units C and D in an m-th pass of the main scan.
Figure 17B:
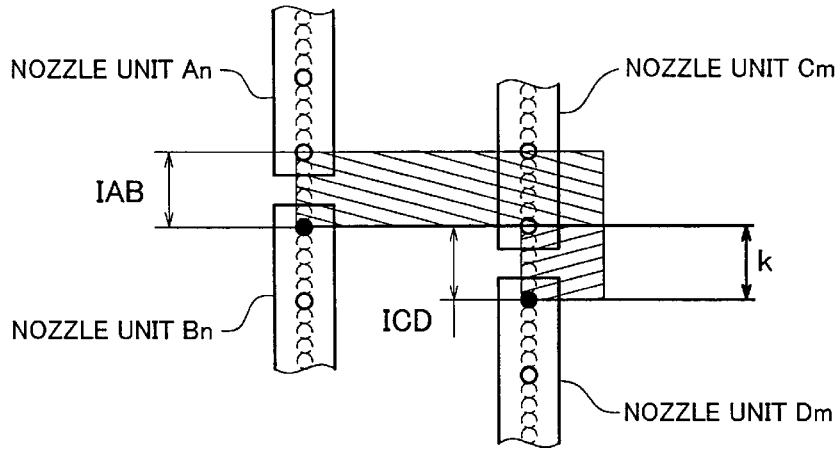
Figure 17C:
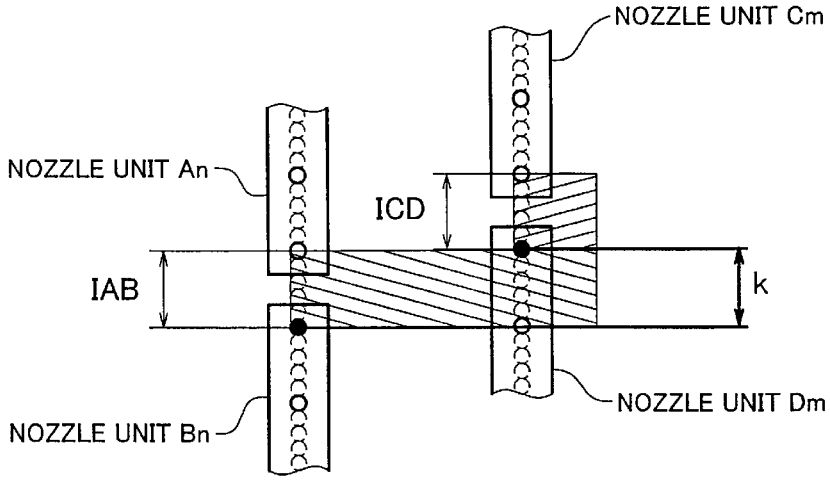
Figure 18:
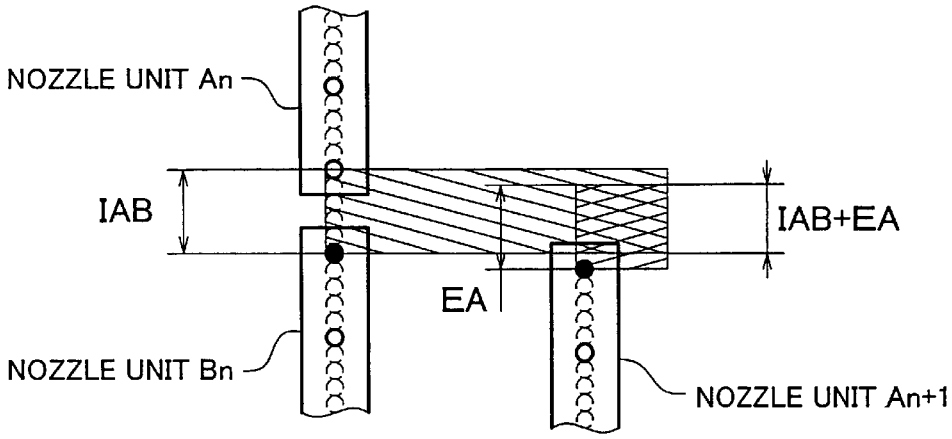
FIG. 18 is an enlarged view showing the positional relationship between the joint of nozzle units A and B in an n-th pass of the main scan and the rear most end of the head assembly in an (n+1)-th pass of the main scan.
Figure 19:
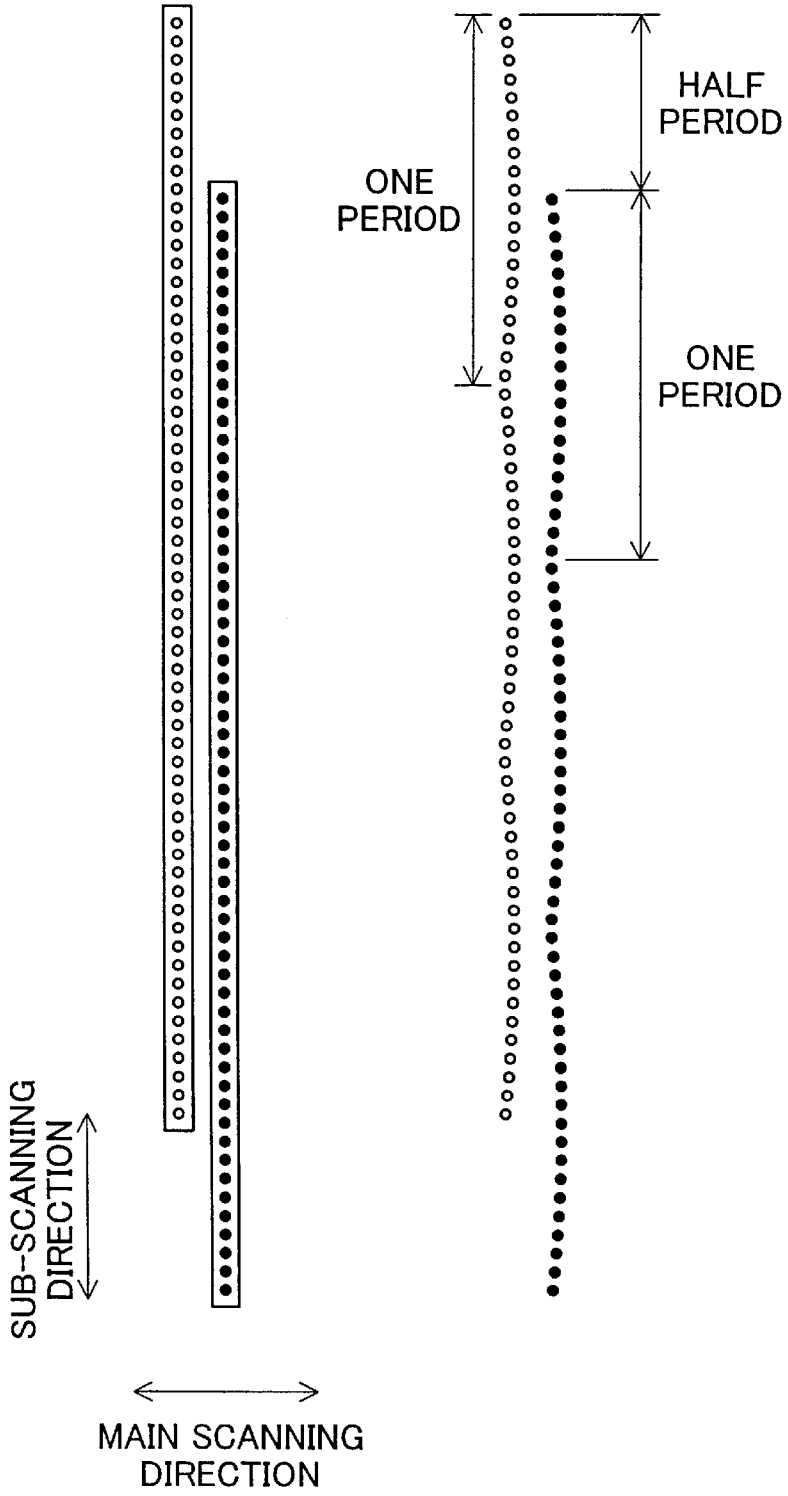
FIG. 19 conceptually shows the principle of averaging variations in ink ejection characteristic by arranging plural nozzle units in such a manner that the period of the variation in ink ejection characteristic due to the structure of the nozzle unit is successively shifted.
Figure 20:
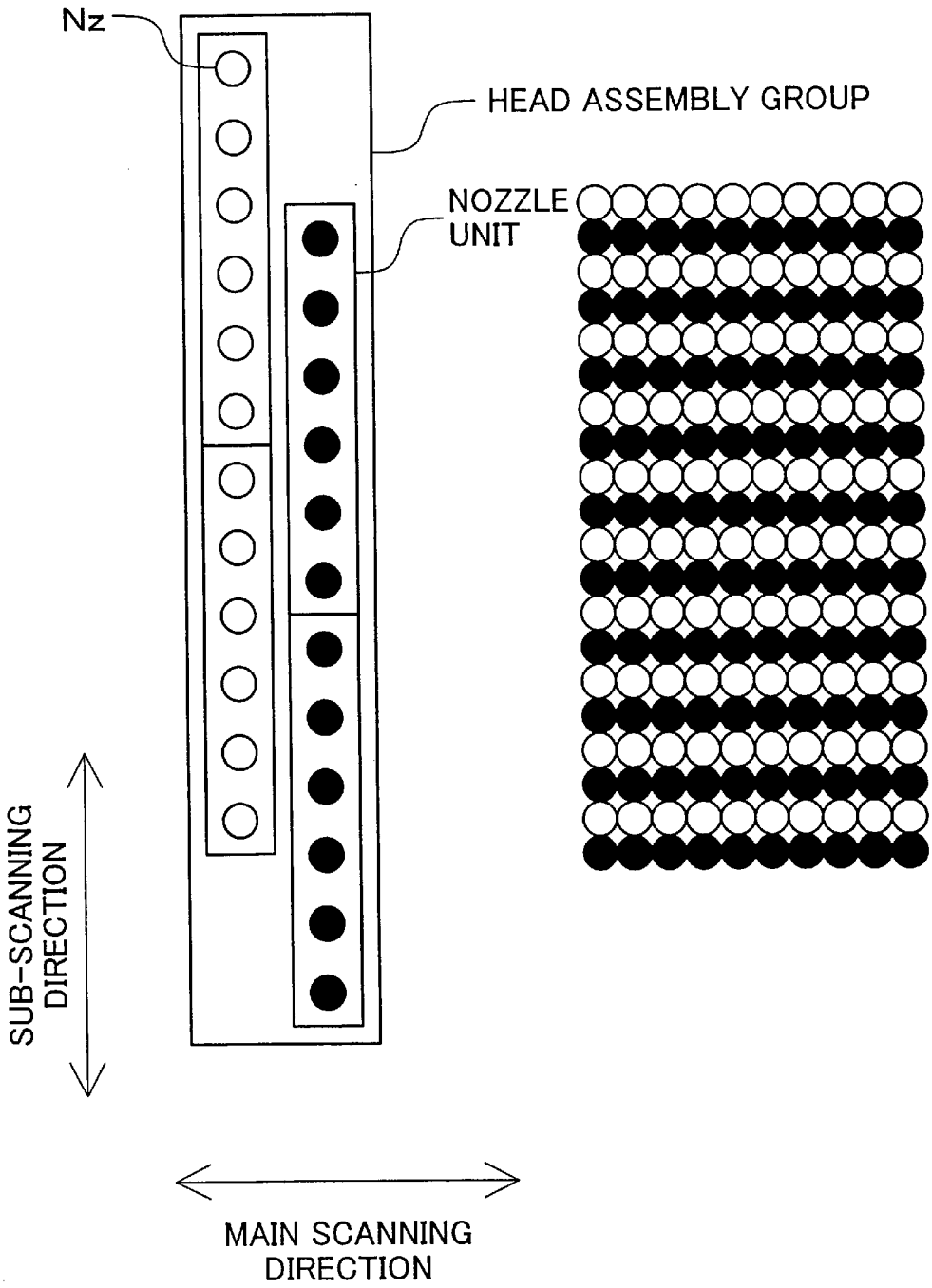
FIG. 20 shows the principle of averaging variations in ink ejection characteristic by arranging plural head assemblies in such a manner that the period of the variation in ink ejection characteristic arising in the nozzle unit is successively shifted.
Figure 21:
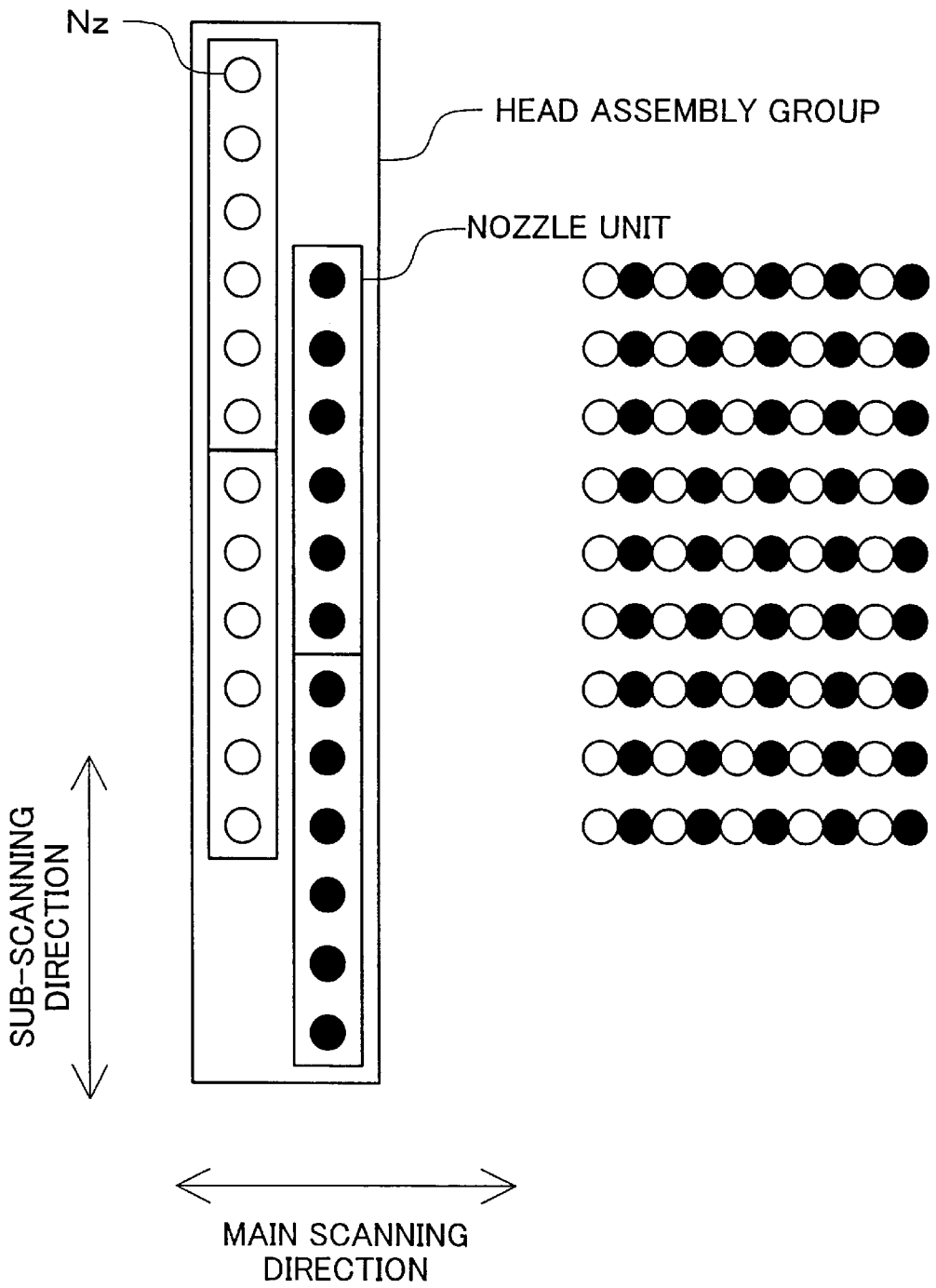
FIG. 21 shows one arrangement of plural head assemblies to make the nozzle positions in the respective head assemblies coincident with each other, where ink droplets are simultaneously ejected from one nozzle unit.
Figure 22:
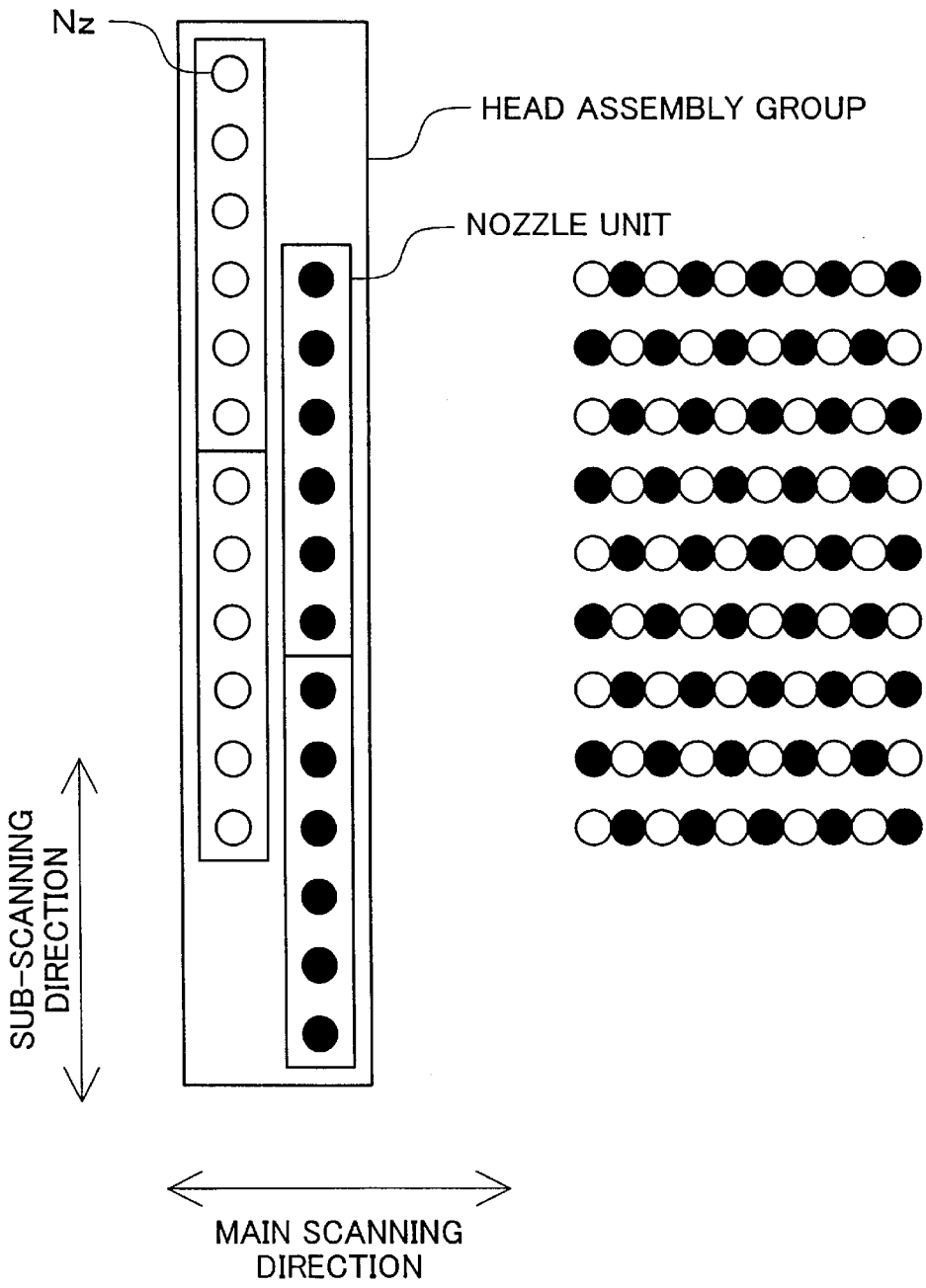
FIG. 22 shows another arrangement of plural head assemblies to make the nozzle positions in the respective head assemblies coincident with each other, where ink droplets are alternately ejected from two nozzle units.

A third arrangement applicable to the color printer 20 of the embodiment uses a plurality of different amounts of sub-scan, in order to prevent any overlap of the printing positions corresponding to the joints of the adjoining nozzle units in the course of the sub-scan of the head assembly. FIG. 14 shows an example of the third arrangement. The head assembly includes four nozzle units, and each nozzle unit has 320 nozzles. The nozzle pitch k=4 and the overlap number s=1. In this nozzle configuration, the total number of nozzles is not prime to the nozzle pitch k, so that the interlace can not be completed at the fixed amount of sub-scan. In this case, the interlace is completed by the sub-scan of irregular feeding.

The conditions to complete the interlace in the case of irregular feeding discussed above are applied to this example. It is here required that one cycle consists of four passes of sub-scan (Condition 1), that the sum of the amounts of sub-scan in one cycle is equal to 5120 (=320×4×4) (Condition 2), and that all the offset values 1 through 3 appear once in one cycle (Condition 3). In the example of FIG. 14, the head assembly is subjected to the four passes of the sub-scan, and the sum of the amounts of sub-scan is equal to 5120 (=602+1303+1802+1413). The raster lines formed after the first pass of the sub-scan have the offset value mod(602,4)=2. The raster lines formed after the second pass of the sub-scan have the offset value mod(602+1303,4)=1. The raster lines formed after the third pass of the sub-scan have the offset value mod(602+1303+1802,4)=3. Namely all the offset values 1 through 3 appear once. All the required conditions are fulfilled, and the interlace is thus completed.

The positions where the joints of the adjoining nozzle units and the rear most end of the head assembly appear in the course of the sub-scan are shown by the areas filled with the slant lines in FIG. 14. As clearly understood from the illustration of FIG. 14, selection of the appropriate set of amounts of sub-scan effectively prevents any overlap of the printing positions corresponding to the joints of the nozzle units or any overlap of the printing positions corresponding to the rear most end of the head assembly and the joint of the nozzle units. This arrangement effectively prevents the picture quality-deteriorating factors, which are due to the individual difference between the adjoining nozzle units, the attachment error, and the error in feeding amount of sub-scan of the head assembly, from collectively arising at an identical position on a resulting printed image to worsen the printing quality.

The present invention is not restricted to the above embodiment or its arrangements or applications, but there may be many modifications, changes, and alterations without departing from the scope or spirit of the main characteristics of the present invention. For example, the software (application programs) attaining the above functions may be supplied to the main memory of the computer system or to any external storage device via a communication line.

Industrial Applicability

As described above, the printing apparatus of the present invention uses a head assembly, which is obtained by combining a plurality of nozzle units and includes a large number of nozzle arrays. The arrangement of nozzle units enables an image to be printed while preventing deterioration of the picture quality at positions corresponding to the joints of the adjoining nozzle units. This technique is suitable for printing a large-sized, high-quality image at a high speed.

What is claimed is:

1. A printing apparatus that causes ink droplets to be ejected from a nozzle array, which is formed by arranging a plurality of nozzles, so as to create ink dots on a printing medium and thereby print an image, said printing apparatus comprising:

a head assembly obtained by combining a plurality of nozzle units arranged in an extending direction of the nozzle array, that is, in a sub-scanning direction, where each nozzle unit has the plurality of nozzles;

a raster formation unit that creates the ink dots while moving said head assembly in a main scanning direction, which crosses the sub-scanning direction, so as to form raster lines on the printing medium at intervals of a k raster lines space, where each raster line represents an array of dots; and a sub-scan unit that moves said head assembly in the sub-scanning direction, which crosses the main scanning direction, by a predetermined amount, wherein said sub-scan unit carries out respective passes of sub-scan of said head assembly, in order to record all raster lines included in an effective area on the printing medium, each pass of the sub-scan causing a rear most nozzle included in each nozzle unit to be located at a specific position that is apart by at least k raster lines from a certain position where a rear most nozzle included in another nozzle unit is located prior to the pass of the sub-scan.

2. A printing apparatus in accordance with claim 1, wherein said raster formation unit forms N effective raster lines by every pass of main scan, the effective raster lines representing net raster lines formed by each pass of the main scan, said sub-scan unit carries out each pass of the sub-scan of said head assembly by a specific distance corresponding to N raster lines, and said head assembly comprises said plurality of nozzle units arranged such that the rear most nozzle included in each nozzle unit is located at a specific position, which is apart by at least k raster lines from a certain position that is apart from a rear most nozzle of said head assembly by a distance corresponding to a specific number of raster lines, which is an integral multiple of N.

3. A printing apparatus in accordance with claim 1, wherein said raster formation unit forms N effective raster lines by every pass of main scan, the effective raster lines representing net raster lines formed by each pass of the main scan, said raster formation unit causing each nozzle unit to form at least k effective raster lines by every pass of the main scan and to form an identical number of raster lines at specific intervals corresponding to k raster lines, where k is prime to N, and said sub-scan unit carries out each pass of the sub-scan by a fixed distance corresponding to N raster lines.

4. A printing apparatus in accordance with claim 1, said printing apparatus further comprising:

a sub-scan amount storage unit that stores a set of feeding amounts of sub-scan, which are used in the sub-scan of said head assembly, wherein said sub-scan unit successively carries out the respective passes of the sub-scan according to the set of feeding amounts stored, said raster formation unit causes each nozzle unit to form n raster lines at intervals of the k raster lines space, and said sub-scan amount storage unit stores a set of values defined by that absolute value of a difference between each cumulative value, which is obtained by successively accumulating the feeding amounts of sub-scan, and an integral multiple of n×k is not less than k, as the set of feeding amounts of sub-scan.

5. A printing apparatus in accordance with claim 1, said printing apparatus further comprising a head assembly group, which includes a plurality of said head assemblies arranged in the main scanning direction, wherein said plurality of head assemblies included in said head assembly group are arranged to be shifted in position in the sub-scanning direction, such that the respective head assemblies do not have overlapping variations in ejection characteristic of the ink droplets, which periodically appear in the sub-scanning direction due to structure of said nozzle unit.

6. A printing apparatus in accordance with claim 5, wherein said plurality of head assemblies included in said head assembly group are arranged to be shifted in position in the sub-scanning direction, so as to prevent their periodic variations in at least one of ejection speed of the ink droplets and ejection amount of the ink droplets from overlapping one another.

7. A printing apparatus in accordance with claim 5, wherein said plurality of head assemblies included in said head assembly group are arranged, such that nozzle positions in the respective head assemblies are shifted in the main scanning direction by approximately half a nozzle pitch.

8. A printing apparatus in accordance with claim 5, wherein said plurality of head assemblies included in said head assembly group are arranged, such that nozzle positions in the respective head assemblies are identical in the main scanning direction.

9. A printing apparatus that causes ink droplets to be ejected from a nozzle array, which is formed by arranging a plurality of nozzles, so as to create ink dots on a printing medium and thereby print an image, said printing apparatus comprising a head assembly obtained by combining a plurality of nozzle units arranged in an extending direction of the nozzle array, that is, in a sub-scanning direction, where each nozzle unit has the plurality of nozzles;

a raster formation unit that creates the ink dots while moving said head assembly in a direction that crosses the extending direction of the nozzle array, so as to form raster lines on the printing medium at intervals of a k raster lines space, where each raster line represents an array of dots; and a sub-scan unit that moves said head assembly in the sub-scanning direction, which crosses an extending direction of the raster lines, by a predetermined amount and carries out respective passes of sub-scan to record all raster lines included in an effective area on the printing medium, wherein said plurality of nozzle units are arranged, such that each pass of the sub-scan of said head assembly causes a rear most nozzle included in each nozzle unit to be located at a specific position that is apart by at least k raster lines from a certain position where a rear most nozzle included in another nozzle unit is located prior to the pass of the sub-scan.

10. A method of printing an image by causing ink droplets to be ejected from a nozzle array, which is formed by arranging a plurality of nozzles, to create ink dots on a printing medium while changing a relative position of the nozzle array to the printing medium, said method comprising the steps of:

creating ink dots while successively moving a head assembly in a direction that crosses an extending direction of the nozzle array, so as to form raster lines on the printing medium at intervals of a k raster lines space, where each raster line represents an array of dots and said head assembly is obtained by combining a plurality of nozzle units arranged in the extending direction of the nozzle array, each nozzle unit having the plurality of nozzles; and successively moving said head assembly in the extending direction of the nozzle array by a predetermined amount, so as to record all raster lines included in an effective area on the printing medium, each movement of said head assembly causing a rear most nozzle included in each nozzle unit to be located at a specific position that is apart by at least k raster lines from a certain position where a rear most nozzle included in another nozzle unit is located prior to the movement of said head assembly.

11. A recording medium in which a program is recorded in a computer readable manner to actualize a method of printing an image by causing ink droplets to be ejected from a nozzle array, which is formed by arranging a plurality of nozzles, to create ink dots on a printing medium while changing a relative position of the nozzle array to the printing medium; said program causing a computer to attain the functions of:

creating ink dots while successively changing the relative position of the nozzle array to the printing medium in a direction that crosses an extending direction of the nozzle array, so as to form raster lines on the printing medium at intervals of a k raster lines space, where each raster line represents an array of dots; and successively changing the relative position of the nozzle array to the printing medium in the extending direction of the nozzle array by a predetermined amount, so as to record all raster lines included in an effective area on the printing medium, each change of the relative position causing a rear most nozzle included in each nozzle unit among plural nozzle units to be located at a specific position that is apart by at least k raster lines from a certain position where a rear most nozzle included in another nozzle unit among said plural nozzle units is located prior to the change of the relative position, where each nozzle unit has the plurality of nozzles.

* * * * *